US012006078B1

(12) United States Patent
McCafferty

(10) Patent No.: US 12,006,078 B1
(45) Date of Patent: Jun. 11, 2024

(54) CASE LOADER

(71) Applicant: BURTOFT, LLC, Caldwell, ID (US)

(72) Inventor: Matthew Robert McCafferty, Caldwell, ID (US)

(73) Assignee: BURTOFT, LLC, Caldwell, ID (US)

( * ) Notice: Subject to any disclaimer, the term of this patent is extended or adjusted under 35 U.S.C. 154(b) by 0 days.

(21) Appl. No.: 17/900,062

(22) Filed: Aug. 31, 2022

Related U.S. Application Data

(60) Provisional application No. 63/239,002, filed on Aug. 31, 2021.

(51) Int. Cl.
*B65B 21/16* (2006.01)
*B65B 5/08* (2006.01)
*B65B 5/10* (2006.01)

(52) U.S. Cl.
CPC ..... *B65B 21/16* (2013.01); *B65B 5/08* (2013.01); *B65B 5/101* (2013.01)

(58) Field of Classification Search
CPC ..... B65B 12/16; B65B 5/08; B65B 5/101; B65G 47/20; B65G 2814/0323
See application file for complete search history.

(56) References Cited

U.S. PATENT DOCUMENTS

| | | | | |
|---|---|---|---|---|
| 2,730,279 | A | 1/1956 | Enock | |
| 3,926,336 | A | 12/1975 | Graham et al. | |
| 4,055,943 | A | 11/1977 | Reichert | |
| 4,428,178 | A * | 1/1984 | Burtoft | B65B 5/08 53/244 |
| 2017/0043890 | A1 | 2/2017 | Barkerding | |
| 2021/0261355 | A1 * | 8/2021 | Huskisson | B65G 69/185 |

* cited by examiner

*Primary Examiner* — Thomas M Wittenschlaeger
(74) *Attorney, Agent, or Firm* — AP Patents; Alexander Pokot

(57) ABSTRACT

A case loader is fed containers by a container conveyor. The containers then rest on a hinged ledge. When the number of containers required to fill the case is present in the loader, a first sensor is activated. The cases are conveyed to the loader below and beside the position of the containers. The cases are tipped up and, when in place, they activate the second sensor. When both sensors are activated, the containers drop and fall into a chute (directing the containers from the loading station and into the cases. When the containers have dropped, the ledge is reset to receive the next group of containers. The force of the containers tips the case back onto the conveyor and it is carried away. An optional device may assist in case tipping. An optional device may move case facing edge of each chute.

19 Claims, 18 Drawing Sheets

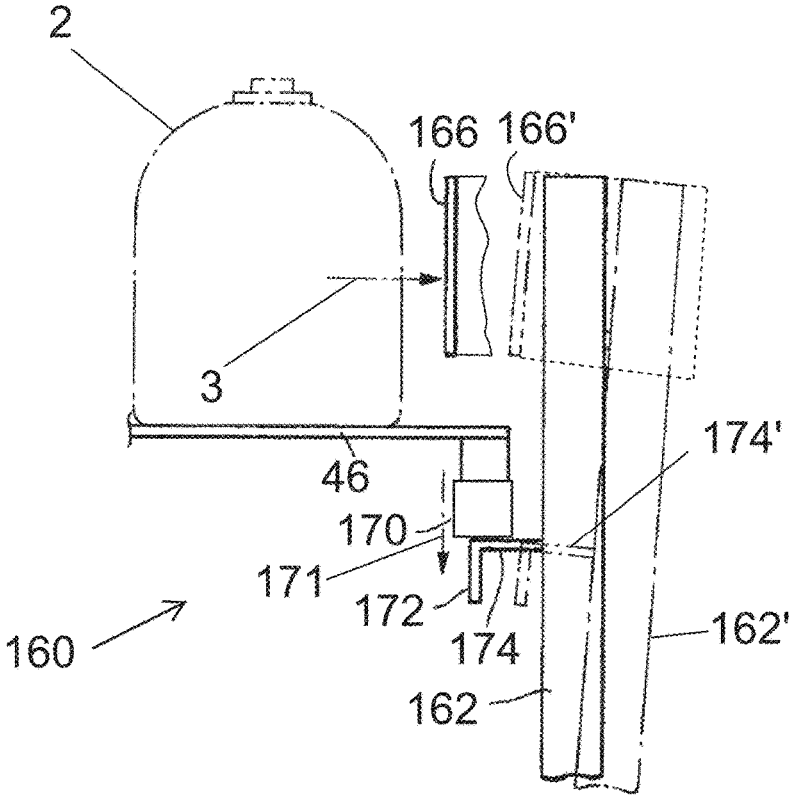
FIG. 10
FIG. 12
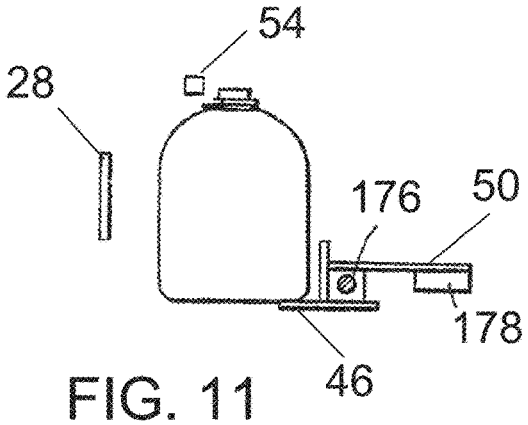
FIG. 11
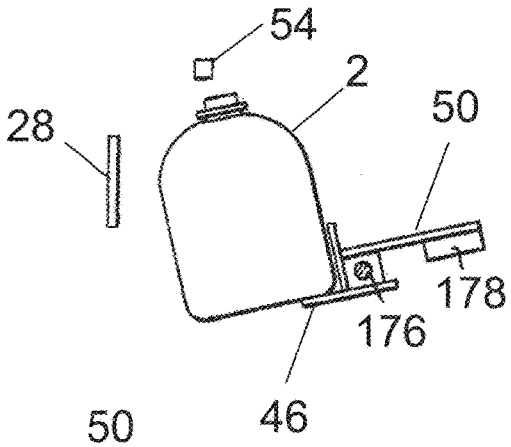
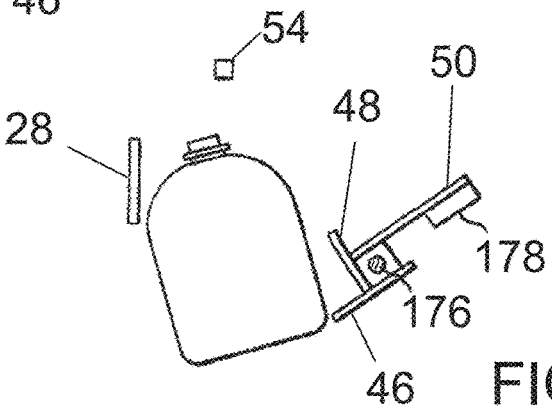
FIG. 13

FIG. 19
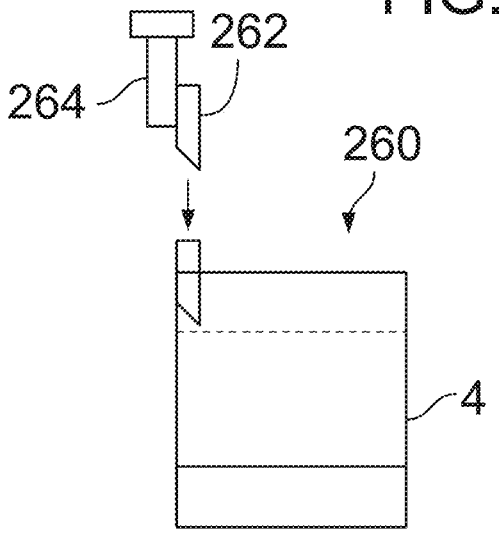
FIG. 20
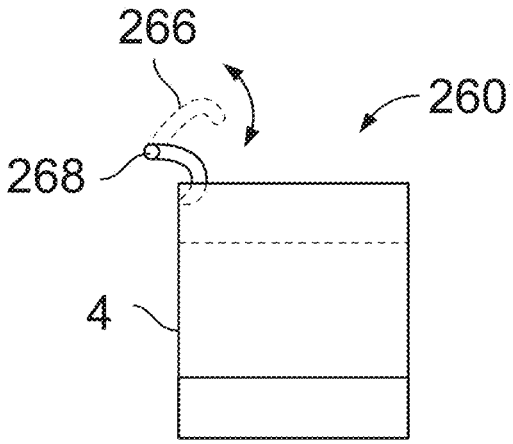
FIG. 21
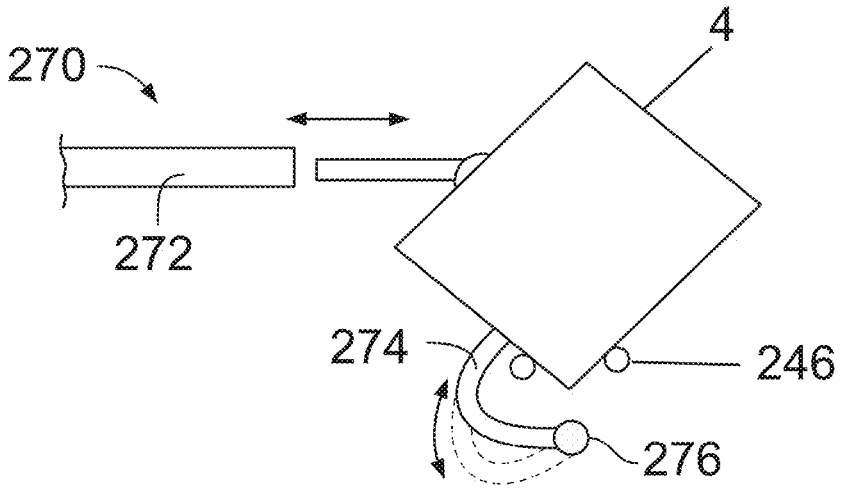
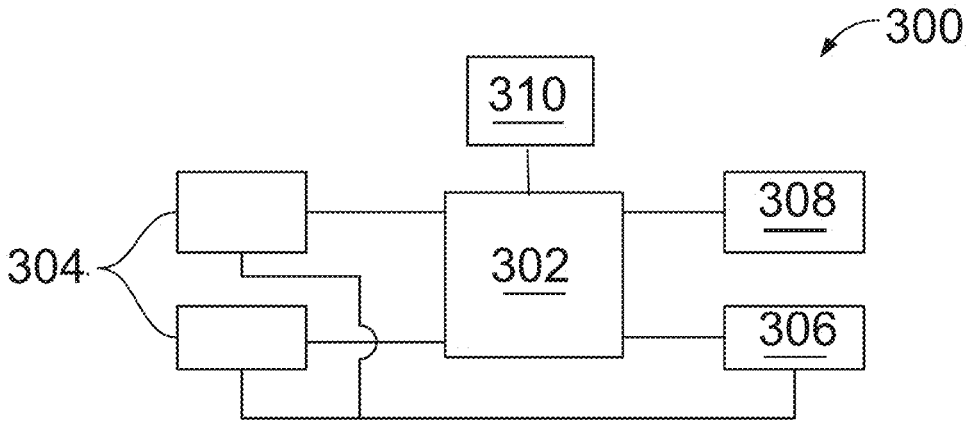
FIG. 22

CASE LOADER

CROSS-REFERENCE TO RELATED APPLICATIONS

This nonprovisional application claims the benefit of priority, under 35 U.S.C. .sctn. 119(e), to U.S. Provisional Patent Application Ser. No. 62/239,002 filed on Aug. 31, 2021 and titled "Case Loader", which is hereby incorporated by reference in its entirety.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND

The subject matter relates to a loader. The subject matter may relate to a loader designed to load multiple articles into an open crate. The subject matter may further relate to an apparatus and method for automatically loading crates with articles which are fed into the apparatus in continuous rows and are then loaded into the container in groups of rows and columns.

BRIEF DESCRIPTION OF THE DRAWINGS

The accompanying drawings are incorporated in and constitute part of the specification and illustrate various embodiments. In the drawings:

FIG. 10 illustrates a partial end view of the case loader, particularly illustrating a container release;

FIG. 11 illustrates a container release with a container support in a support position;

FIG. 12 illustrates a container release with the container support in a partially tripped position;

FIG. 13 illustrates a container release with the container support in a fully tripped position;

FIG. 19 illustrates a diagram of a case assist device designed to relieve a case back pressure on cases being loaded;

FIG. 20 illustrates a diagram of a case assist device designed to relieve a case back pressure on cases being loaded;

FIG. 21 illustrates a diagram of a case assist device;

FIG. 22 illustrates a bloc diagram of a control circuit that can be used with the case loader;

DETAILED DESCRIPTION

Figure 1:
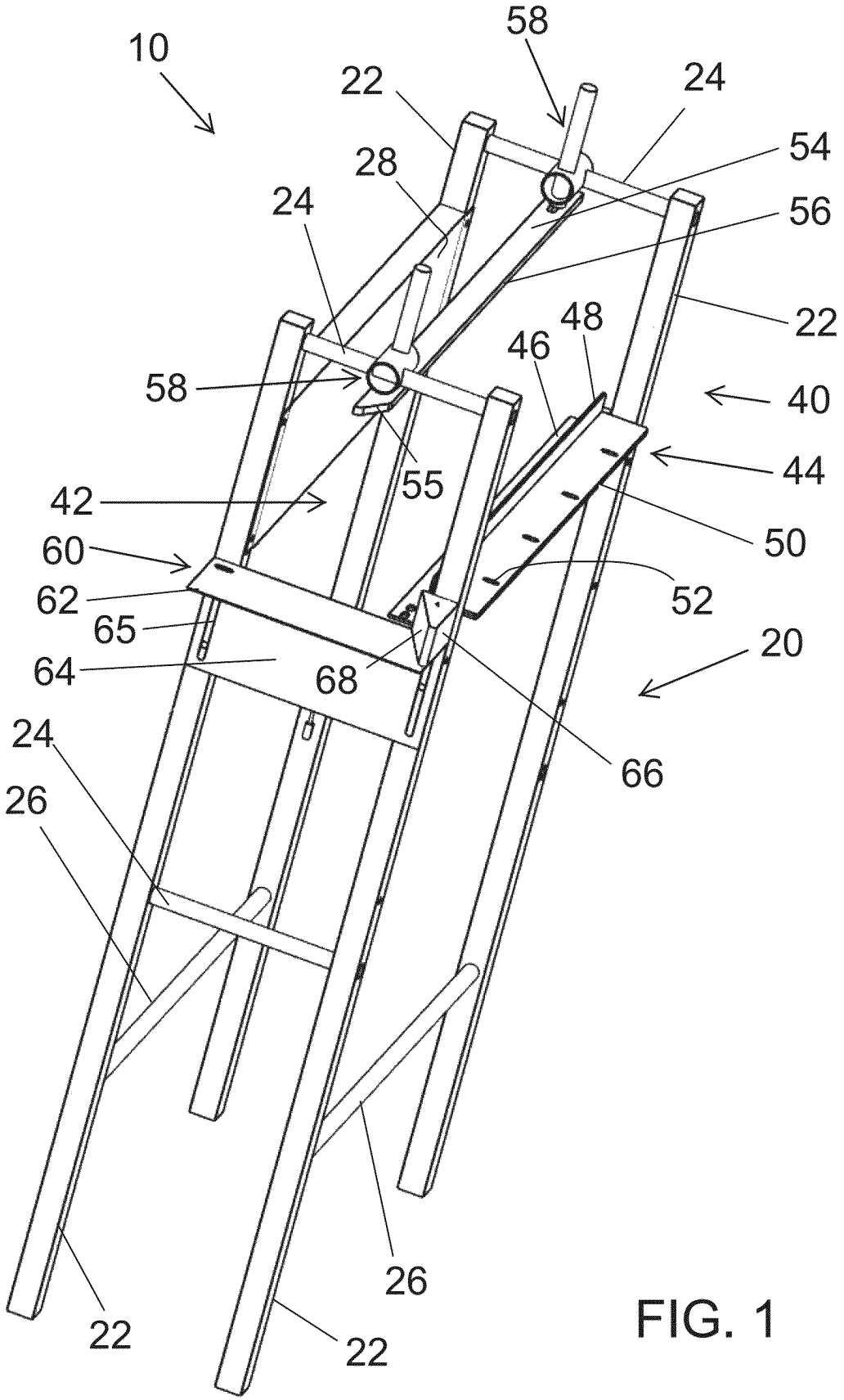
FIG. 1 illustrates a perspective view of a case loader.

Prior to proceeding to the more detailed description of the present subject matter, it should be noted that, for the sake of clarity and understanding, identical components which have identical functions have been identified with identical reference numerals throughout the several views illustrated in the drawing figures.

Features which are described in the context of separate embodiments may also be provided in combination in a single embodiment. Conversely, various features which are, for brevity, described in the context of a single embodiment, may also be provided separately or in any suitable subcombination. The Applicant hereby gives notice that new Claims may be formulated to such features and/or combinations of such features during the prosecution of the present Application or of any further Application derived therefrom.

It is to be understood that the singular forms "a," "an," and "the" include plural referents unless the context clearly dictates otherwise or expressly specified otherwise. Thus, for example, reference to "a component surface" includes reference to one or more of such surfaces.

For purposes here, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes here, the words "comprising," "including," "having," and variants thereof, wherever they appear, shall be construed as open-ended terminology, with the same meaning as if the phrase "at least" were appended after each instance thereof.

The verb "may" is used to designate optionality/noncompulsoriness. In other words, something that "may" can, but need not.

Before elucidating the subject matter shown in the Figures, the present disclosure will be first described in general terms.

A case loader comprises a frame, a container station, a container guide, and a container release. The case loader is designed to load containers into cases.

The container may comprise a bottle. The container may comprise a box. The container may comprise a can. The container may comprise a jug. The container may be designed to contain a liquid. The liquid may be milk. The liquid may be juice. The liquid may be beer. The liquid may be wine. The container may be designed to contain a solid material. The container may be designed to contain a combination of a liquid material and a solid material. The container may be manufactured from a glass material. The container may be manufactured from a plastic material. The plastic material may be a flexible plastic material. The container may be manufactured from a paper material. The container may be provided in different sizes. The container may be provided as a one-gallon container. The container may be provided as a half-gallon container.

The case may comprise an open crate. The open crate may be manufactured from a plastic material. The plastic material may be a rigid plastic. The case may comprise a box. The box may be manufactured from a thin paper material. The box may be manufactured from a cardboard material.

The frame may comprise frame components positioned, during operation, in a vertical plane. Thus, it can be said that the frame components may be positionable in the vertical plane or may be positioned vertically. These components may be referred to as uprights. The frame may comprise frame components positioned, during use, in a horizontal plane. Thus, it can be said that the frame components may be positionable in the horizontal plane or may be positioned horizontally. The frame components positionable in the horizontal plane are attached to the uprights. The horizontally positioned components may be referred to as cross members.

The horizontal and vertical planes do not have to be perfectly orthogonal planes. The orientation of the frame components may be deviated due to manufacturing tolerances. Thus, the vertical and horizontal planes may be referred to respectively as a substantially vertical plane and a substantially horizontal plane.

The above frame components are attached to each other. Attachment of the components may comprise fastening. Attachment of the component may comprise welding. Attachment of the components may comprise a combination of fastening and welding. The cross members may be attached to the uprights with brackets. Uprights may be provided with apertures, each aperture being sized and shaped to receive an end of a cross member therewithin. A fastener, for example such as a set screw, may be used to contact the end of the cross member and prevent unintended separation of the end from the upright.

The frame may be designed as a generally open structure utilizing hollow tubular shaped components, solid rod shape components and components manufactured from flat sheets or flat bar stock material. In applications requiring periodic cleaning of the case loader, open frame provides sufficient access for cleaning solution to contact most if not all surfaces of the frame.

The frame may be designed as a substantially enclosed structure. In other words, the frame as described above, may be provided as an enclosure with a peripheral wall with a hollow interior and openings sized sufficiently to receive containers and to allow passage of the containers into the case that would be positioned next to the frame. The enclosure may comprise a polyhedron shape.

The frame may be designed to be positioned on a surface. In a non-limiting example, such surface is a horizontal floor surface in a manufacturing facility. The frame may be free standing on such horizontal floor surface. The frame may be designed with optional mounting components to attach the frame to the horizontal floor surface. The frame may be designed with adjustable feet to level the frame due to uneven floor surface.

The frame may be designed to be attached to a vertical wall surface. The frame may be designed to be attached to a structure that may be already attached to the horizontal floor surface or to a vertical wall surface. In other words, the frame may be designed to be indirectly attached, in a secure and stationary manner, to the horizontal floor surface or to a vertical wall surface.

The frame may be securely attached to a case conveyor. The frame may be detachably attached to a case conveyor. The frame may be positioned without any attachment to the case conveyor. The frame may be securely attached to a container conveyor. The frame may be detachably attached to a container conveyor. The frame may be positioned without any attachment to the container conveyor.

Two case loaders may be connected to each other. In other words, the frame of one case loader may be attached to a frame of another case loader.

The frame may be designed to mount the container station, the container release, and the container guide in an operative arrangement with each other so that the container can be loaded into the case during operation of the case loader.

A frame portion containing the container station may be designed and installed separately from a frame portion containing the container guide.

The frame defines the container station with a hollow interior sized and shaped sufficiently to receive containers. The container station is designed to receive containers therewithin. The container station comprises a container receiving opening in one end of the frame. The container opening is disposed in an open communication with the hollow interior and is configured to pass the containers into the container station. The container receiving opening may be sized slightly larger than the container.

The container receiving opening may be sized to accommodate containers of different sizes. The container receiving opening may be designed as an adjustable size opening. A partition or a bar may be mounted to move in a relationship to the opening so as to establish an operational portion of such adjustable size opening.

The container station further comprises a first container support with a first ledge, a pivot, a second container support with a second ledge. The container station may be designed with a counterbalance at the first ledge.

The first ledge extends from the container receiving opening. During operation, the first ledge is in contact with a bottom surface of the container. The first ledge may comprise a smooth and a flat surface so that the container may be advanced from the container conveyor with minimal friction. The first ledge may be configured with an optional container alignment component to align and keep the containers in the container station. The first ledge and the container alignment component may be designed as a unitary member with a generally L-shaped cross-section in a plane normal to a length of the first ledge. During operation, one leg of such L-shaped cross-section provides the first ledge and the other leg of such L-shaped cross-section provides the container alignment component. In other words, during operation, the first ledge fits under and around one edge of the container. The first ledge may be designed as a conveyor belt that leads the container into the container station (independent of the conveyor belt below). The first ledge may be provided as a "live" roller conveyor, or as a wheel drive that compresses the container, and while spinning in direction that would advance the container, as long as it is compressed and contacts the wheel. The container will advance while the wheel is spinning.

The second container support is mounted on the frame parallel to the first container support. The second container support defines a second ledge. The second ledge is positioned at a first and second distances from the first ledge. When the first container support is designed with the optional container alignment portion, the second container support may be disposed at a first distance from the first ledge and at a second distance from the container alignment portion. During operation, the second container support is mounted above the first ledge and inwardly from the container alignment portion. In view of the above, the second container support is positioned within the frame to support containers in an upright position. The second ledge may have a taper at the container receiving opening.

The container station may be further designed with an optional component fastened to a rear of the frame adjacent the container station. Such optional component may be referred to as a back panel.

The second container support may be mounted stationary on the frame within the container station. In a non-limiting example, the second container support may comprise an elongated component that is attached to ends of the frame, either directly to the upright or to a component that is attached to two uprights across the end of the frame. Stationary second container support may be provided when the case loader is designed to load containers of one unique size.

The second container support may be mounted adjustably within the frame. In a non-limiting example, the second container support may comprise a first component, two second components, where each second component is attached to one end of the frame in a direction normal to a length of the first component, and a connection between the first component and each of the both second components, where the connection is designed to move the first component in a relationship to both second components. The first component defines the second ledge. The connection may comprise a block at each end of the first component, an aperture through each block, where the axis of the aperture is disposed normal to the length of the first component, and where the second component being sized and shaped to be received within the aperture. In other words, the first component is designed to move away from and toward the first ledge so as to accommodate containers of different sizes and shapes. Each block can be temporarily secured at an adjusted position, for example, with a threaded fastener contacting a surface of a respective second component.

Adjustable container support may be provided when the case loader is designed to load containers of different sizes. Adjustable second container support may be provided when the case loader is designed to load containers of one unique size but where loading container of different sizes may occur on the future.

In view of the above, the second container support may be designed to allow ease of conversion between containers of different sizes.

In view of the above, the first container support supports the container at the bottom and the second container support supports the containers at the top.

In view of the above, first container support and the second container support provide container support system.

The container station may be aligned with a container conveyor. The container conveyor may be a chain-type conveyor. Furthermore, the end of the frame may directly contact the end of the conveyor or may be positioned in a closed proximity thereto so as to provide a transition of the containers from the container conveyor into the container station. The one end of the frame with the container receiving opening may be directly or indirectly secured to the end of container conveyor by any one of fastener, restraint, and welding.

The container station may comprise an optional container transitional component between an end of the container conveyor and the end of the frame designed with the container receiving opening. The transitional component may be a tray. The tray may be configured to be fastened to the frame. In other words, the tray may be permanently or detachably attached to the frame. The tray may be configured to be fastened to the container conveyor and contact or be in a close proximity to the one end of the frame.

The container station may be configured to hold a single container. The container station may be configured to hold a case load of containers in a single column. Such case load may include two or more container.

The container station may be referred to as a container loading station. The container station may be referred to as a container receiving station. The container station may be referred to as a container holding station.

The container guide has at least a portion thereof that may be under the container station during operation of the case loader. The container guide is designed to guide sliding movement of the container from the container station into the case along a container sliding direction. Furthermore, the container guide may be sized and shaped to gravity load containers, received within the container station and released with the container release, into a case though an open end thereof, the case being positioned at an incline relative to a case discharge position during operation of the case loader with the open end of the case facing the slide.

The container guide may be provided as a slide. The slide may comprise a smooth surface between the container facing end and a case facing end. During operation, the case facing end is positioned in a close proximity to an edge of an open end of the case. When the optional back panel is provided, the container facing edge may be positioned to contact the back panel. When the optional back panel is provided, the container facing edge may be positioned at a distance from the back panel without affecting sliding motion of the containers. The slide may be designed to include a portion of the back panel.

The slide may comprise a cross-sectional shape in a plane normal to the container sliding direction, the cross-sectional shape being complimentary to a shape of a peripheral surface of the container.

The slide may comprise a curved shape, either partially or completely, between the container facing end and the case facing end to slow the sliding motion of the container from the container facing edge toward the case facing end.

A width of the slide may be sized to accept only a single container across the width. A width of the slide may be sized to according to accept two containers across the width. A width of the slide may be sized to according to accept more than two containers across the width. Generally speaking, the width of the slide may be sized in accordance with a width of the open end of the case, particularly at the case facing edge.

The container guide may be designed with one side extending outwardly from one edge of the slide surface to control sliding movement of the container. The side does not have to be attached to the slide. The side may be attached to the frame adjacent a side edge of the slide. The side may be referred to as a side wall or as a slide wall.

The container guide may be designed with two sides extending outwardly from each side edge of the slide to control sliding movement of the container. In other words, the slide may comprise two sides (or two side walls) disposed at a distance from each other and a slide component positioned within the distance between the two sides. The slide component may be referred to as a bottom wall. The slide with two sides may be referred to as a chute.

The container guide may be designed with three sides disposed at a distance from each other and in a series with each other along a case movement direction and two slide components, each slide component being positioned within a distance between two sides. The slide with three sides may be referred to as two chutes.

The container guide may be designed with four sides disposed at a distance from each other and in a series with each other along a case movement direction and two slide components, each slide component being positioned within a distance between two sides. The slide with four sides may be also referred to as two chutes.

The slide, as described above, may be mounted in a stationary position. The slide may be designed with an adjustable position of the case facing edge so as to improve interface between the case facing edge of the slide and the edge of the case, and thus improve accuracy of loading container(s) into the case. This slide may be designed from a bendable material, for example as a component cut from a sheet of thin metal or as a component manufactured from a bendable plastic. It would be understandable that the bendable material also defines a flexible material.

The case facing portion containing the case facing edge may be manually bent in a vertical direction during operation of the case loader. In other words, the case facing portion may be configured to adjustably move in the vertical direction.

When the container guide comprises two slides, the case facing edge of the slide positioned further away from the container receiving opening is disposed above a case facing edge of a slide positioned closer to the container receiving opening so as to deposit a second row of containers into the advancing case.

The case loader, as described above, may be designed with an optional container guide alignment mechanism. Such container guide alignment mechanism may be designed as an actuator to adjustably move the case facing edge of the slide in a vertical direction. The actuator may be designed and positioned to align the case facing edge with the edge of the case. The actuator may be designed and positioned to change elevation of the case facing edge of the slide.

The actuator may comprise a manually operable actuator. This manually operable actuator may comprise a first threaded component having one end connected to the case facing portion and a second threaded component fixed in a stationary position and receiving the first threaded component therewithin for a reciprocal movement. The second threaded component may be a threaded nut. The second threaded component may be a threaded block. The connection between the threaded component and the case facing portion may comprise a pivot.

The actuator may be a single actuator designed to independently adjust two different slides. This actuator may comprise a common mounting component, two (first) components that are connected to a common mounting component and that have an internal thread and two (second) components that have an external thread, where the external thread is complimentary to the internal thread. Each end of the (second) component with the external thread is in a pivotal connection with an exterior surface of a respective slide. The pivotal connection may include a bracket attached to the exterior surface, an aperture through the thickness of the bracket, an aperture through a thickness of the (second) component with the external thread and a pin (shaft) passed through both apertures.

The actuator may be designed as a power operable actuator. One end of the power operable actuator will be then connected to the case facing portion and the other end of the power operable actuator may be connected to the frame. Such power operable actuator may comprise a pneumatic cylinder. Such power operable actuator may comprise a hydraulic cylinder. Such power operable actuator may comprise an electrically operated drive. Such power operable actuator may comprise an electrically operated solenoid. The power operable actuator may be operated from a remote location during operation of the case loader and does require a presence of human operator in a close proximity to the interface between the case facing edge of the slide and the edge of the case. Two powered actuators may be attached to a common mounting component, essentially taking a place of the (second) component with the external thread, as described above.

On the case loader having two or more slides, each slide may be connected to a separate actuator. On the case loader having two or more slides, some slides may be individually connected to the actuator.

When the case loader is designed with a single slide to load multiple rows of the containers into the case, the actuator may be also configured to align the case facing edge of a selected slide with the position to drop each row of containers into the case.

Accordingly, a case loader may comprise a frame, a container station, a container release, a container guide positioned under the container station, the container guide being sized and shaped to load, due to gravity and after the containers are released with the container release, containers positioned within the container station into a case though an open end thereof, the case being in an inclined position relative to an upright position, and a device configured to align a case facing edge of the slide with an edge of a case being positioned, in the inclined position, next to the slide.

The case loader may be designed with an optional device to adjust a side of the container guide so as to vary an effective width of the container guide, particularly at the case facing edge. The device may have a first portion in a threadable connection with the frame and a second portion that is positioned to contact the side. Threadable adjustment of the first portion toward the interior of the frame reduces the effective width of the container guide. Threadable adjustment of the first portion away from the interior of the frame increases the effective width of the container guide. The container guide equipped with optional device may be referred as a container guide of a varying width.

The case loader, as described above, may be adapted with an optional slide component to assist in slowing a velocity of a sliding movement of the container before the container drops into the case. Such slide component may be referred to as a deflector. The deflector may be pivotally attached to the frame and connected to an actuator that may be also attached to the frame. This actuator, that may be a damper, returns the deflector into a position to contact a container, after previous container contacts the deflector and pushes the deflector outwardly due to a momentum generated during the sliding movement of the container toward the case.

The container release may comprise a pivot, a counterbalance, a container sensor, a case sensor, a latch, an arm, and a latch target.

The pivot may comprise two pins. Each pin extends from one end of the first ledge and is connected to the frame. In a non-limiting example, the pin may be received within an aperture in one upright. In a non-limiting example, the pin may be received within an aperture in a block connected to one upright. Thus, the pivot pivotally connects the first ledge to the frame. The pivot may be referred to as a hinge. Thus, the container release may comprise a hinged ledge.

The counterbalance may be designed with a weighted component that extends from the first ledge in a direction normal to the length thereof. The counterbalance may be referred to as a ledge counterweight. The latch is being connected to the case sensor. The arm may have an upper portion contacting a surface of the container. The pivot pivotally attaches the arm to the frame. The latch is connected to the arm. The latch target being selectively retained and released by the latch. The latch target is connected to the case sensor and being released by the latch to allow a pivoting movement of the arm. It can be also said that the latch being selectively retained and released by the latch target.

The arm may be designed with a ledge support that is attached to the arm mediate ends thereof. The ledge support is designed to releaseably support a portion of the first ledge.

The container release may comprise a case sensor, a container sensor, and a releaseable latch between the case sensor and the container sensor. The case sensor may comprise a case stop, and a pivotal connection between the case stop and the frame. The container sensor may comprise a container stop, and a pivotal connection between the container stop and the frame. The releaseable latch may be designed with a linkage that connects the container sensor with the case sensor. The container sensor and the case sensor may provide a sensor system within the case loader. The sensor system may be designed as a mechanical system without a reliance on sensor that are required to be connected to a power source, either electric, pneumatic or hydraulic. The sensor system may be designed with at least one sensor, such as a photo eye, a proximity sensor, and the like sensors.

The ledge counterweight may be provided as a component of the container release. Accordingly, container release may be designed with a case sensor, a latch connected to the case sensor, an arm with an upper portion contacting a surface of the container, a pivot pivotally attaching the arm on the frame, a latch target, a pivot pivotally connecting the ledge to the frame for pivoting between a container receiving position and a container release position, a block attached to the arm adjacent the upper portion thereof, the block maintaining the ledge in the container receiving position and allowing pivoting of the ledge into the container release position upon pivoting of the arm, and a counterweight attached to the ledge so as to return the ledge into the container receiving position.

In view of the above, the container release may be designed with a pivotable container ledge, a pivotable container arm, a container sensor attached to the pivotable arm, a pivotable case arm, a case sensor attached to the pivotable case arm, a linkage connecting the case sensor with the container sensor, the linkage configured to pivot container ledge in a response to sensing the case with the case sensor and sensing the container with the container sensor.

The case loader, as described above, may further comprise a case station positioned adjacent the frame, the case station designed to pivot the cases from an upright position into the inclined position and then back into the upright position. The case station may comprise a portion of the case conveyor, that can be a chain conveyor. The case station also comprises a case guiding arrangement consisting of leveled and inclined guides to change orientation of the cases for loading. During operation, the case station is aligned with the case conveyor. The case station may be attached to an end of the case conveyor.

The case station may be securely connected to the frame. The case station may be securely connected to the frame during installation of the case loader in a process (manufacturing) facility. The case station may be securely connected to the frame during installation of the case loader prior to delivery of the case loader to the process facility In view of the above, the case loader may be designed to load, by way of gravity, containers into a case, where the cases are being advanced on a case conveyor and where the case first tilts into the case loading position due to the design of the container station and then tilts from the case loading position into a case discharge position due to weight of containers received (loaded) within the case. The case is tipped-up and tilted in the case loading position. The case is positioned upright in the case discharge position. When the case loader is designed with two container guides, the case is partially loaded at a (first) container guide that is disposed adjacent to the container receiving opening and is fully loaded at the (second) container guide that is disposed further away from the container receiving opening. When the case loader is designed with more than two container guides, the case is fully loaded at the last container guide and is partially loaded at the first and any inter mediate container guide(s).

In applications where cases are continuously advanced on a case conveyor, a back pressure may be generated onto the cases being loaded from the cases on a conveyor that are next in line or waiting to be loaded. In this application, the case loader, as described above, may comprise an optional case assist device designed to assist a movement of the case loaded with containers from the case loading position into the case discharge position. The case assist device may be designed to assist tilting or tipping of the cases into the case discharge position. Since cases are inclined during container loading operation and since the cases are being continuously fed on the case conveyor, the case assist device may be designed to overcome a force (back pressure) from non-loaded and/or partially loaded cases acting onto the case that is now fully loaded and must be positioned upright, in the case discharge position, for movement in a discharge direction. Thus, the case assist device may be referred to as a case back pressure relieving device. The case assist device may be retrofitted on case loaders presently in use.

The case assist device may be designed with an actuator configured to generate a pivoting movement, and an arm connected to the actuator for the pivoting movement, the arm being shaped and sized to contact an edge of the case being positioned further from the frame and being aligned with a case discharge direction, the arm pulling the case, being fully loaded with containers into the case discharge position due to the pivoting movement generated by the actuator.

The case assist device may be designed with a linear actuator configured to push the container into the upright position.

The case assist device may be designed with an actuator configured to generate a pivoting movement, a support connectable to the frame and to the actuator, the support extending outwardly from the frame in a direction of the case when support connected to the frame and an arm connected to the support for the pivoting movement, the arm shaped and sized to contact a side edge of an adjacent case to the case being fully loaded so as to move the adjacent case a distance away from the case being fully loaded.

The case assist device may be designed with a support connectable to each of the frame and the actuator. The support is attached to the frame so as to extend outwardly from the frame in a direction of the case. This case assist device further comprises an actuator mounted on a support, the actuator configured to generate a pivoting movement, and an arm connected to the actuator for the pivoting movement, the arm shaped and sized to contact a side edge of an adjacent case to the case being fully loaded so as to move the adjacent case a distance away from the case being fully loaded.

The case assist device may be designed with an actuator configured to generate a rotational movement and a roller connected to the actuator for the rotational movement, the roller positionable in a friction contact with a side surface of the case during operation of the case loader. The friction contact assists the movement of the fully loaded case into the case discharge position during the rotation of the roller to move the case into the case discharge position. The actuator and the roller may be connected to the frame. The actuator and the roller may be connected to the case conveyor. The actuator and the roller may be connected to a separate structure. In either connection arrangement, the roller engages the case that being tilted into a case loading position and does not impede a movement of the case along a discharge direction. The actuator and the roller may be employed as a case stop sensor where a force (pressure) on the roller can be sensed, for example with a force gage, and a corresponding signal outputted to a control unit.

The case assist device may be designed with an actuator configured to generate a linear movement and a stop connected to the actuator, the stop having a sloped (inclined) surface. This case assist device being positioned so that the sloped surface contacts an edge of an adjacent case to the case being fully loaded so as to move the adjacent case a distance away from the case being fully loaded.

The case assist device may be designed with an actuator configured to generate a linear movement in a vertical direction and a stop connected to the actuator. The case assist device being positioned so that the stop contacts a surface of an adjacent case to the case being loaded so as to move the adjacent case a distance away from the case being loaded.

In view of the above, the case assist device does not have to directly assist the case being loaded by reliving the back pressure from a case behind the case being loaded.

In view of the above, the case assist device provides means for assisting a movement of a loaded case from a case loading position into a case discharge position.

In view of the above, the case assist device provides means for reliving a back pressure onto the case being loaded with containers or onto the case fully loaded with containers.

This case loader may be designed with a case assist device to temporarily retain the case in a tilted case loading position so that the case cannot tilt into the case discharge position unless the case is fully loaded, i.e. the cases contains all containers that the case is designed to contain. In other words, the device is configured to prevent undesirable or unintended tilting of the case into the case discharge position. This device may be referred to as a restraint. This device may be also referred to as a means for preventing unintended tilt of the case being loaded with containers.

The restraint is operable to selectively restraint and release the case positioned at the slide. The restraint may comprise an arm with a flange that is configured to engage an edge of the container. The arm is mounted in a pivotal connection with the frame. An actuator is provided to pivot the arm between a first position where the flange engages the edge of the case and a second position where the flange is disposed at a distance from the edge of the case. The actuator may be a cylinder. The cylinder may be a pneumatic cylinder. The cylinder may be a hydraulic cylinder. The restraint control circuit may comprise a timer and one or two solenoid valves to supply and terminate fluid supply to the cylinder. The timer settings may be based on a time duration between arrival of the case, loaded with a first tier of containers, at the second slide and loadings of the second and third tiers. The restraint is operable to engage the edge of the case arrived at the second slide and release the case after the second tier of containers is loaded. This device may be referred to as a pull device.

The arm may be provided as a "captured" plate, that has a cylinder mounted to the plate, that advances a plate forward, to capture the container, and retracts backward to allow the container to rock. Or could be a "dual rod" or "dual piston" cylinder that actuates forward or backward in a similar motion (of advancing straight and retracting straight). This may be mounted to the slide and free up space below, eliminating a hook, a shaft, the bearings, the cylinder, the cylinder mounts, etc.

The restraint control circuit may be adapted with an optional sensor configured to sense a presence of the second tier of containers in the case. Such sensor may be a photo eye.

This device may be designed as a device with an actuator that is mounted external to the frame and that is operable to contact an edge or a surface of the case and apply a force to bias the case into the case loading position. The actuator is further operable to release the force and allow tilting of the case into the case discharge position. The actuator may be of a linear type, as described above. The actuator may be attached, either directly or indirectly, to a case conveyor. The actuator may be attached to an independent structure or surface adjacent the case conveyor. This device may use the control circuit as described above. This device may be referred to as a push device.

The pull device or push device, as described above, may be referred to as a case tilt prevention device.

The pull device or push device, as described above, provide a means for preventing tilting of a partially loaded case.

The actuator may be pivotally connected, at one end, to a mounting component that is then stationary or adjustable mounted to the frame. In other words, the case tilt prevention device may be detachably attached to the frame. Thus, a case loader configured to load four containers through two slides into a single case may be easily changed-over to load six smaller containers through two slides into the single case by installing such case tilt prevention device and adjusting the container support in the container station.

An optional safety device may be provided to temporarily prevent pivoting of the first ledge and unintended (accidental) release of the containers received within the container station during a maintenance procedure on an operating loader or if a jam or other issue needs to be cleared up during operation. The optional safety device is designed and mounted to move between a first position to allow pivoting of the first ledge and a second position to prevent pivoting of the first ledge.

Such optional safety device may be provided as a latch in a pivotal connection with the frame. The pivotal connection may be with an upright. A handle may be attached to the safety latch for ease of use. The safety latch is pivotable between a first position to allow pivoting of the first ledge and a second position to prevent pivoting of the first ledge. The safety latch, when pivoted into a position in a contact with or being adjacent to the flange or the first ledge, prevents an unintended pivoting of the first ledge.

The optional safety device may be provided as a powered device. This powered device may be designed as an actuator. The actuator may be a linear actuator mounted in a first position to allow pivoting of the first ledge and a second position to prevent pivoting of the first ledge. The linear actuator may be a cylinder. The linear actuator may be a linear solenoid. The actuator may be a rotary solenoid. The actuator may be energized to prevent pivoting of the first ledge. The actuator may be deenergized to prevent pivoting of the first ledge. The actuator is connected to a source of power. In an application where the actuator is connected to a source of electric energy, a switch may be inserted into a connection between the power source and actuator to energize or deenergize the actuator. In an application where the actuator is connected to a source of fluid energy, pneumatic or hydraulic, a valve may be provided. This actuator may be also controlled by way of one or more electrically powered solenoid valves. A stationary portion of the actuator may be mounted to the frame. The actuator may be mounted, either directly or indirectly, to the upright adjacent the first ledge.

The optional safety design may be designed similar to the case assist devices above.

The case loader may be designed to load four containers, received in a single column, through two container guides into two rows or tiers within a single case.

The case loader may be designed to load four containers, received in a single column of two containers, through one slide into two tiers within a single case. This case loader is designed with the actuator, as described above, to adjustably move the case facing portion in a vertical direction and with the tilt prevention device, as described above.

The case loader may be designed to load six containers, received in a single column, through two slides into three tiers within a single case. This case loader may be designed such that the case is loaded with a single tier of three containers at a first slide and is loaded with two tiers of three containers each at the second slide.

The case loader may be designed to load six containers, received in a single column of three containers, through one slide into three tiers within a single case. This case loader may be also designed with the actuator, as described above, to adjustably move the case facing portion in a vertical direction and with the tilt prevention device, as described above, to temporarily retain the case in the case loading position.

In view of the above, the case loader is fed containers by a container conveyor. The containers in the case loader rest on a hinged ledge. When the number of containers required to fill the case is present in the loader, a container sensor is activated. The container sensor may be referred to as a first sensor. The cases are conveyed to the loader below and beside the position of the containers. The cases are tipped up and, when in place, they activate the case sensor. The case sensor may be referred to as a second sensor. When both sensors are activated, the containers drop and fall into a chute (slide) directing the containers from the loading station and into the cases. The chutes reorient the containers from a single line into the rows and columns required to fill the cases. The loader may fill one case entirely in one cycle, two cases half full on each cycle, or several cases partially full on each cycle. When the containers have dropped, the ledge is reset to receive the next group of containers. The force of the containers tips the case back onto the conveyor and it is carried away.

In view of the above, a method of loading a plurality of containers into a case at a packing (case loading) station may comprise loading the packing station with a single column of containers from a container conveyor, sensing when the case load of containers is in the packing station, placing a plurality of cases in an inclined case loading position at the packing station, beneath and beside the column of containers, sensing when the cases are in the inclined case loading position, dropping the containers when the two sensors detect a case load of containers and the cases, guiding each container along an inclined chute from its first position in the container station to its second position in the case, and assisting a movement of the packed case into an upright case discharged position.

In view of the above, a method of loading a plurality of containers into a case at a packing (case loading) station may comprise loading the packing station with a single column of containers from a container conveyor, sensing when the case load of containers is in the packing station, placing a plurality of cases in an inclined case loading position at the packing station, beneath and beside the column of containers, sensing when the cases are in the inclined case loading position, dropping the containers when the two sensors detect a case load of containers and the cases, aligning a case facing portion of an inclined slide or chute with an edge of the inclined case, and guiding the containers along the inclined slide chute from its first position in the container station to its second position in the case.

As has been described above, container may be provided in different types. One container type may be a plastic bottle. The plastic bottle may contain milk. The plastic bottle may contain juice. Such plastic bottle is characterized by flexible peripheral wall, particularly mediate the bottom and top of the bottle. The plastic bottle for milk or juice may be referred to as a jug. During operation, as the plastic bottles are continuously fed by the container conveyor, the bottles loaded into the case loader are subjected to a (back) pressure from containers remaining outside of the case loader. When the plastic bottles are filled with milk or juice, the effective width of the bottle may be reduced from its original width due to such pressure. As an example, a four-inch wide half-gallon milk bottle (may reduce in size by about half-an-inch. As these bottles slide down the slide, they reestablish their original width to fit into a twelve-inch crate. The width reduction in the container section may affect an ability of bottles to slide down the slide.

To alleviate this potential problem, the case loader may be designed with a container divider. The container divider may be referred to as a container guide. The container divider may be referred to as a container separator. The container divider may be referred to as a lane divider. Such divider may be positioned below the container support and contact the bottles as they begin their sliding movement. In an application where the case loader comprises two slides, the case loader may be designed with 2 independent dividers, one for each slide. Furthermore, the case loader may be designed with slides having a different width at the container receiving edge as compared with a width at the case facing edge. Furthermore, in the above application directed to loading half-gallon milk bottles through two slides in three tiers within the single case, a width of the container facing edge in one slide may be different than the width of the container facing edge in the other slide. Since the first three leading bottles are pressed against the stop, the width of the container divider is sized so as to compress the bottles as they are entering a portion of the slide between the sides.

A flat bar may be provided to run between dividers. A spacer, that may be manufactured from a plastic material, may be also provided. The flat bar and spacer may make up the thickness of the two cases where the two cases contact each other. A plastic case may be approximately ½" thick, and the spacer makes up for ¾" and the guides make up approximately ⅜" (in their thickness; ¾"+⅜"=1⅛") to keep the pattern of the containers within the opening of the two side by side cases being loaded).

The lane dividers may be made adjustable to accommodate different thicknesses of the cases. In an example, plastic cases and corrugate boxes may be used on the same conveyor line.

A device, for example such as a container restraint, may be integrated into the container infeed portion of the case loader to prevent excessive back pressure onto containers within the container station, where such back pressure may affect the casing process.

It is possible that a light gauge case may not be able to handle the rotation of the impact of the drop, or the bottom glued portion may not be able to withstand the impact of the container leaving the slide. In this case, a solid bottom ledge may be necessary.

It may also be necessary that after the case is fully loaded filled (at slide 2), that the full case may need to be advanced out of the loading area, and a tilting member may be necessary to tilt the full case, mitigating the case from being damaged in the casing process.

An indexer or a wheel drive may be added to advance the case.

A loop inverter may be positioned at one side of the case loader, for example for plastic cases in a dairy industry. The loop inverter may be connected to the case loader, as described above.

A device configured to seal, by gluing or taping, open flaps of a corrugated/carton (case) box may be positioned on a discharge end of the case loader. In other words, the method of loading cases with containers may also include an optional step of sealing open flaps of the case after the containers are loaded.

Now in a reference to the drawings.

FIG. 1 illustrates a front perspective view of a case loader 10 with a frame 20, and a container station 40. The frame 20 is illustrated with four first members or uprights 22, second members or cross members 24 and third members or cross members 26. An optional panel 28 is illustrated as being attached to a pair of uprights 22 that define a rear of the case loader 10.

The container station 40 includes a container receiving opening 42 in a side portion of the frame 20, between a pair of uprights 22. A first container support 44 extends between the side uprights 22 from the container receiving opening 42. A length of the first container support is determined based on a number (case load) of containers to be supported at one time within the container station 40. The first container support 44 is designed with a ledge 46, a first flange 48 and a second flange 50. The ledge 46 and the first flange 48 are illustrated as defining an L-shaped configuration of the first container support 44. The ledge 46 is aligned with a bottom surface of a container received through the container receiving opening 42. The ledge 46 may be referred to as a first ledge or as a first container ledge. The first flange 48 provides an optional container alignment component. Thus, the first container support 44 fits under and around one edge of the container. The second flange 50 is illustrated with apertures 52 to fasten a counterbalance 178.

A second container support 54 also extends between side uprights 22 from the container receiving opening 42 but is adjustably connected to the second members 24 with fittings 58. The second container support 54 has a container edge 55 that may be tapered at the container receiving opening 42, and a container support edge 56 that contacts an upper portion of the container. The container edge 55 may be referred to as a second ledge or as a second container ledge.

Each of the first container support 44 and the second container support 54 is a movable container support. Furthermore, the second container support 44 is an adjustable container support by way of fittings 58 slideably adjustable on cross members 24.

In view of the above, the first container support 44 supports the container at the bottom and the second container support 50 supports the containers 2 at the top.

In view of the above, first container support 44 and the second container support 54 provide container support system.

An optional tray that may be provided to bridge a gap between the frame 20 and a container conveyor (not shown), which may be a bet conveyor, is referenced with numeral 60. Such optional tray 60 transitions containers from the container conveyor into the container station 40. The tray 60 may be is lustrated as an L-shaped component with a horizontal portion 62 positioned to receive bottom portion of the container and a vertical portion 64 with apertures 65 so as to fasten the optional container transition component 60 to the frame 20. The vertical portion 64 may be permanently attached to the frame 20, for example by a welding method. The optional tray 60 may also include a block 66 with a tapered surface 68 to guide containers into the container receiving opening 42. The optional tray 60 may be also provided as a component of the container conveyor.

Figure 2:
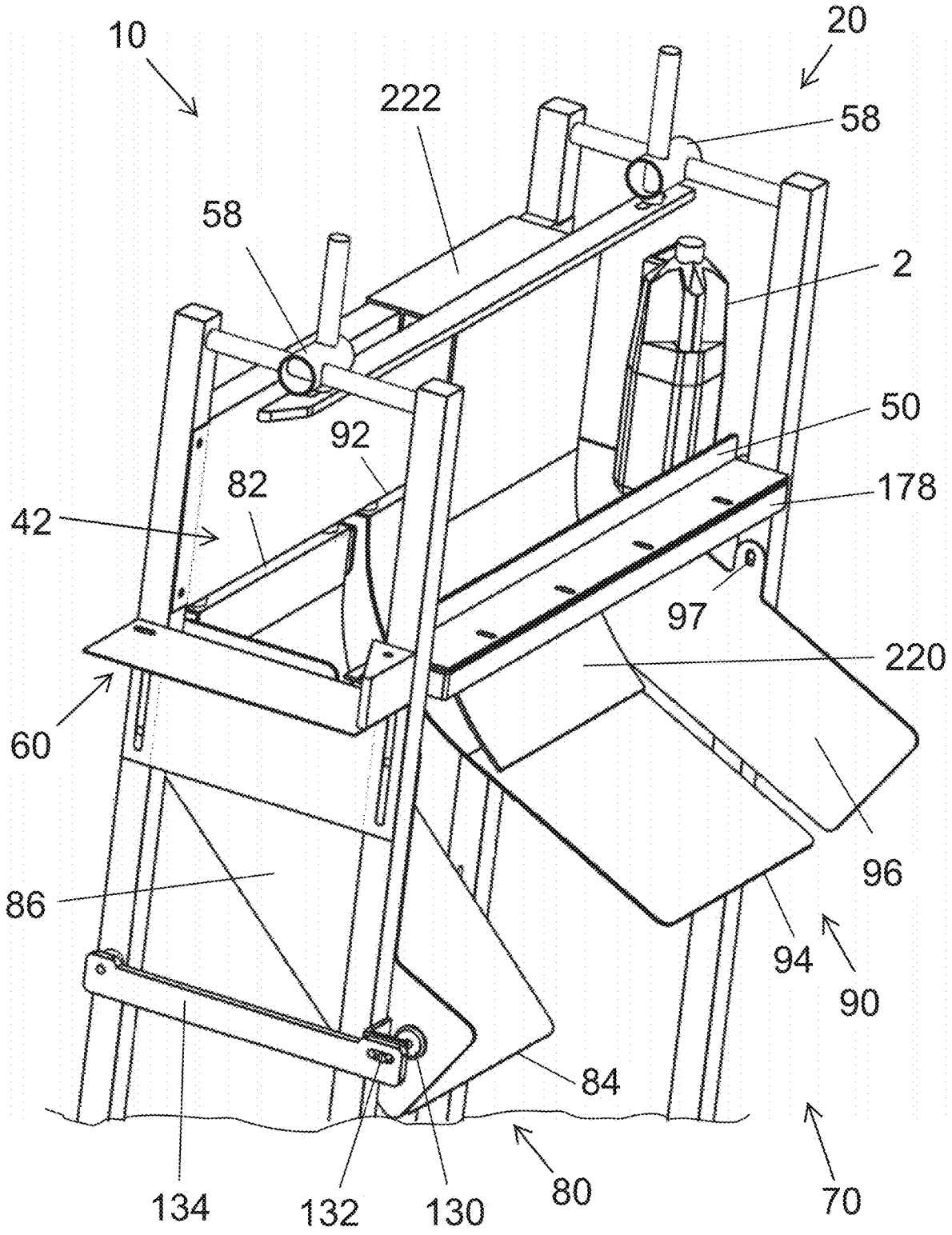
FIG. 2 illustrates a partial perspective view of the case loader of FIG. 1, shown with a container guide.

FIG. 2 illustrates a partial perspective view of the case loader 10 of FIG. 1, particularly illustrating a container guide 70 that is designed as two slides 80 and 90. Slide 80 defines a container facing edge 82 and a case facing edge 84. The container guide 70 is also illustrated with a side 86. Slide 90 defines a container facing edge 92 and a case facing edge 94. The container guide 70 is further illustrated with a side 96. The side 96 may be fastened to the upright 22 at an apertured mounting portion 97. In view of the above, a position of each side 86, 96 at a case facing edge of a respective slide may be made adjustable. A component 130 may be designed with a first portion threadably received at 132 within an arm 134 designed to be attached to the one or two uprights 22 and with a second portion designed to contact the side 86. The component 130 may be threadably adjusted to either move the side 86 toward the interior of the frame 20 and toward an edge of the slide 80, thus decreasing an effective width of the slide 80 or move the side 86 outwardly, away from the edge of the slide 80, thus increasing an effective width of the slide 80. A similar arrangement may be employed with the slide 90.

The case facing edges 84 and 94 are disposed at different elevations within the case loader 10 so as to guide containers 2 into the case 4 for loading at different tiers. In the case loader 10, the case facing edge 84 is illustrated as being positioned lower than the case facing edge 94 to allow the slide 80 to load a first tier of containers 2.

A container guide insert 220 is also illustrated in FIG. 2.

Figure 3:
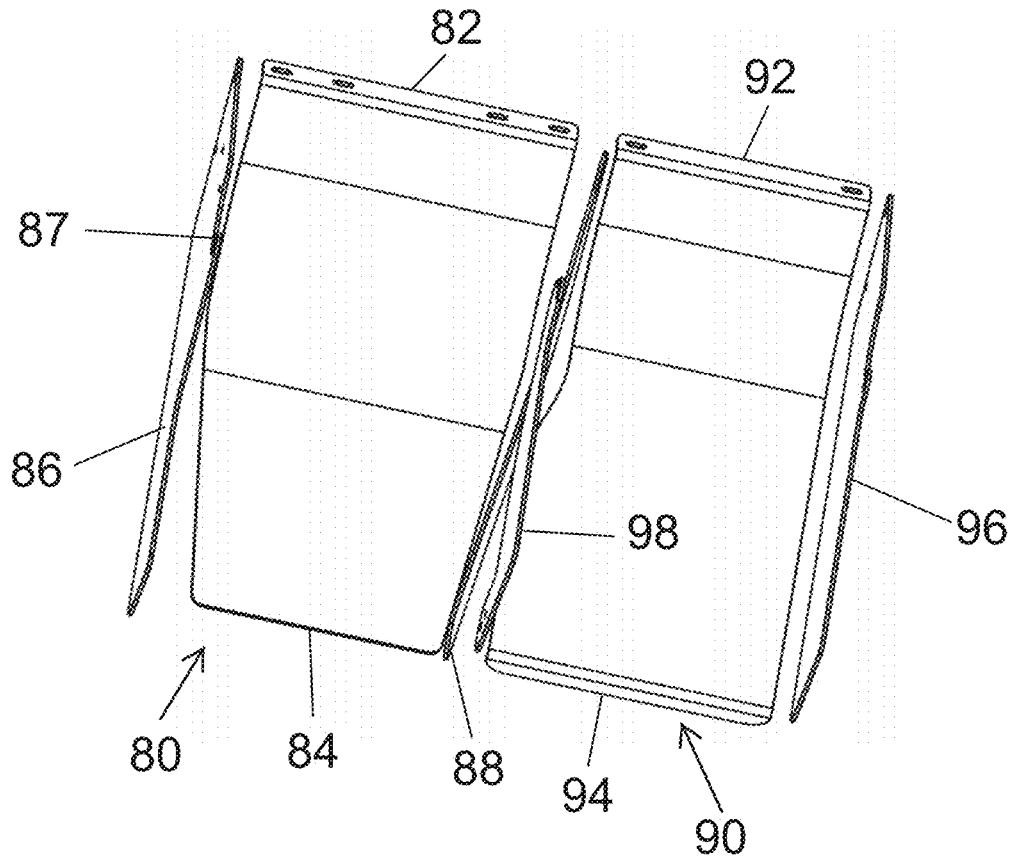
FIG. 3 illustrates a perspective view of the container guide of FIG. 2.

FIG. 3 illustrates a front perspective view of the container slides 80 and 90. FIG. 3 also illustrates another side 88 of the slide 80 and another side 98 of the slide 90 that are positioned adjacent each other. The sides 88 and 98 may cross over each other, as is illustrated, adjacent a respective case facing edge. Such cross-over may improve guidance of the containers sliding under gravity into a case. FIG. 3 further illustrates that sides do not have to be attached to a respective slide. Container facing edges 82 and 92 may be adapted with apertures to fasten the slides 80 and 90 respectively to the frame 20. Side 80 is further illustrated with an apertured mounting portion 87.

Figure 4:
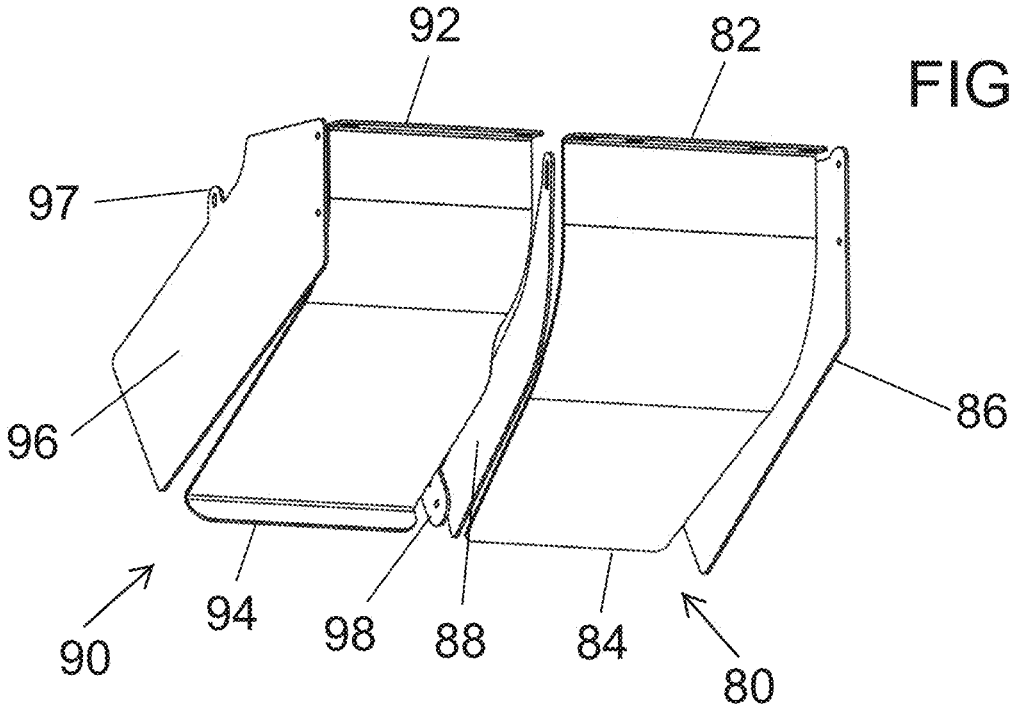
FIG. 4 illustrates a rear perspective view of the container guide.

FIG. 4 illustrates a rear perspective view of the container slides 80 and 90. Further, the container guide 70 of FIGS. 3-4 is illustrated with four sides and two slides. Each side may be referred to as a side wall and each slide may be referred to as a bottom wall. Thus, the container guide 70 of FIGS. 3-4 is illustrated with four side walls and two bottom walls.

Figure 5:
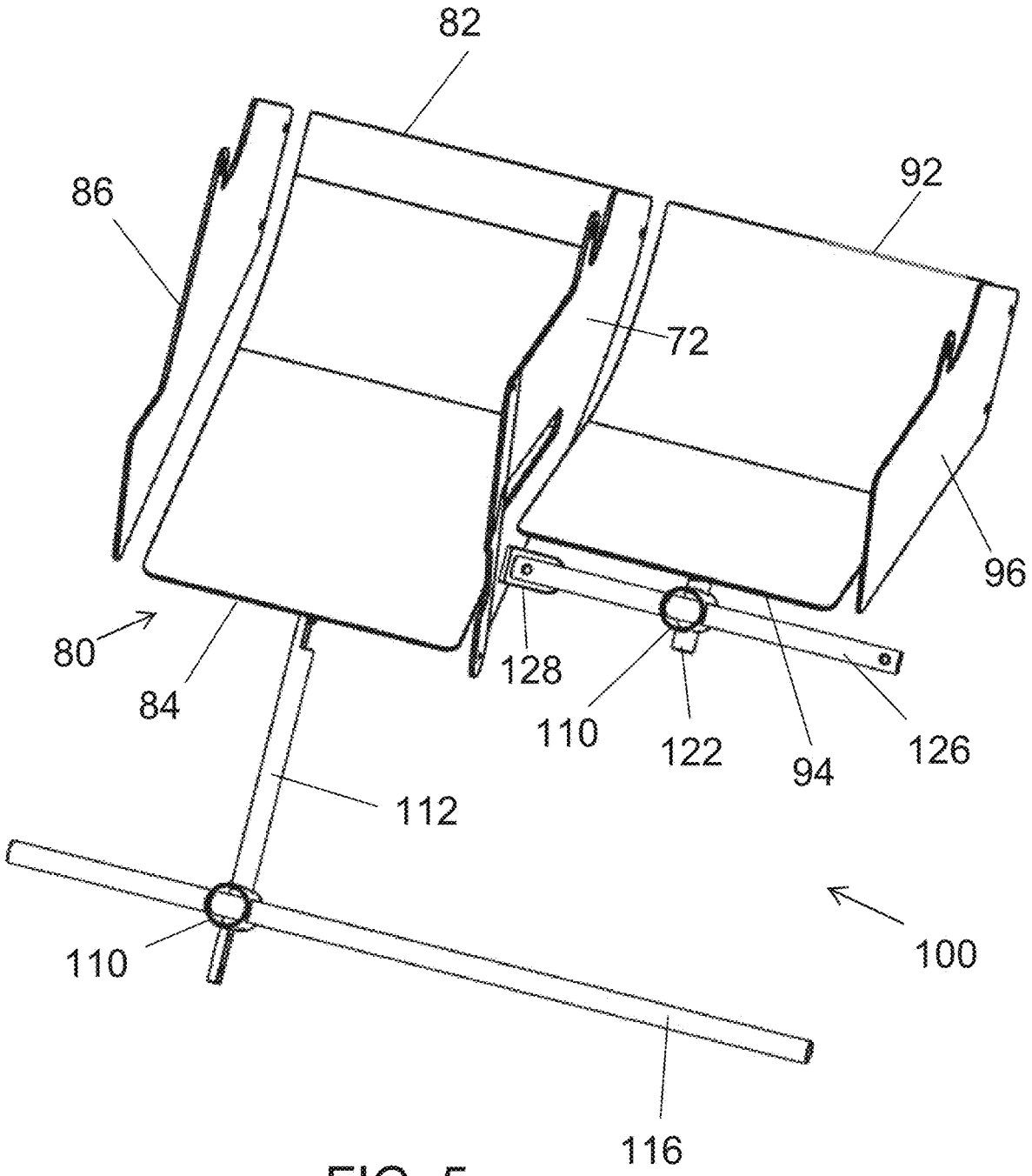
FIG. 5 illustrates a front perspective view of the container guide of FIGS. 3-4 with a container guide alignment mechanism.

FIG. 5 illustrates a front perspective view of the container guide 70 with slides 80 and 90 separated by a single interior side 72. Thus, the container guide 70 is illustrated a being designed with three sides and two slides. FIG. 5 further illustrates container guide alignment mechanism 100. A first component 110 has an internal thread. A second component 112 has a complimentary external thread that compliments an internal thread of the first component 110. The first component 110 is being further illustrated as being adjustably mounted on a mounting component 116 that is secured to the frame 20. Such mounting component 116 may be the third member 26 of the frame 20. The second component 112 is connected to the slide 80. The design may be reversed where the first component 110 is provided with an external thread and the second component 112 is provided with an internal thread. In either case, the first and second components, 110 and 112 respectively, are being illustrated in an adjustably threadable connection with each other.

A first component 110 has an internal thread. A second component 122 has a complimentary external thread that compliments an internal thread of the first component 110. The first component 110 is being further illustrated as being adjustably mounted on a mounting component 126 that is secured to the frame 20 at one end and to the interior side 72 at an opposite end via a bracket 128. The second component 122 is connected to the slide 90. The design may be reversed where the first component 110 is provided with an external thread and the second component 122 is provided with an internal thread. In either case, the first and second components, 110 and 122 respectively, are being illustrated in an adjustably threadable connection with each other.

The container guide 70 of FIGS. 4-5 may be retrofitted on case loaders already in use.

Figure 6:
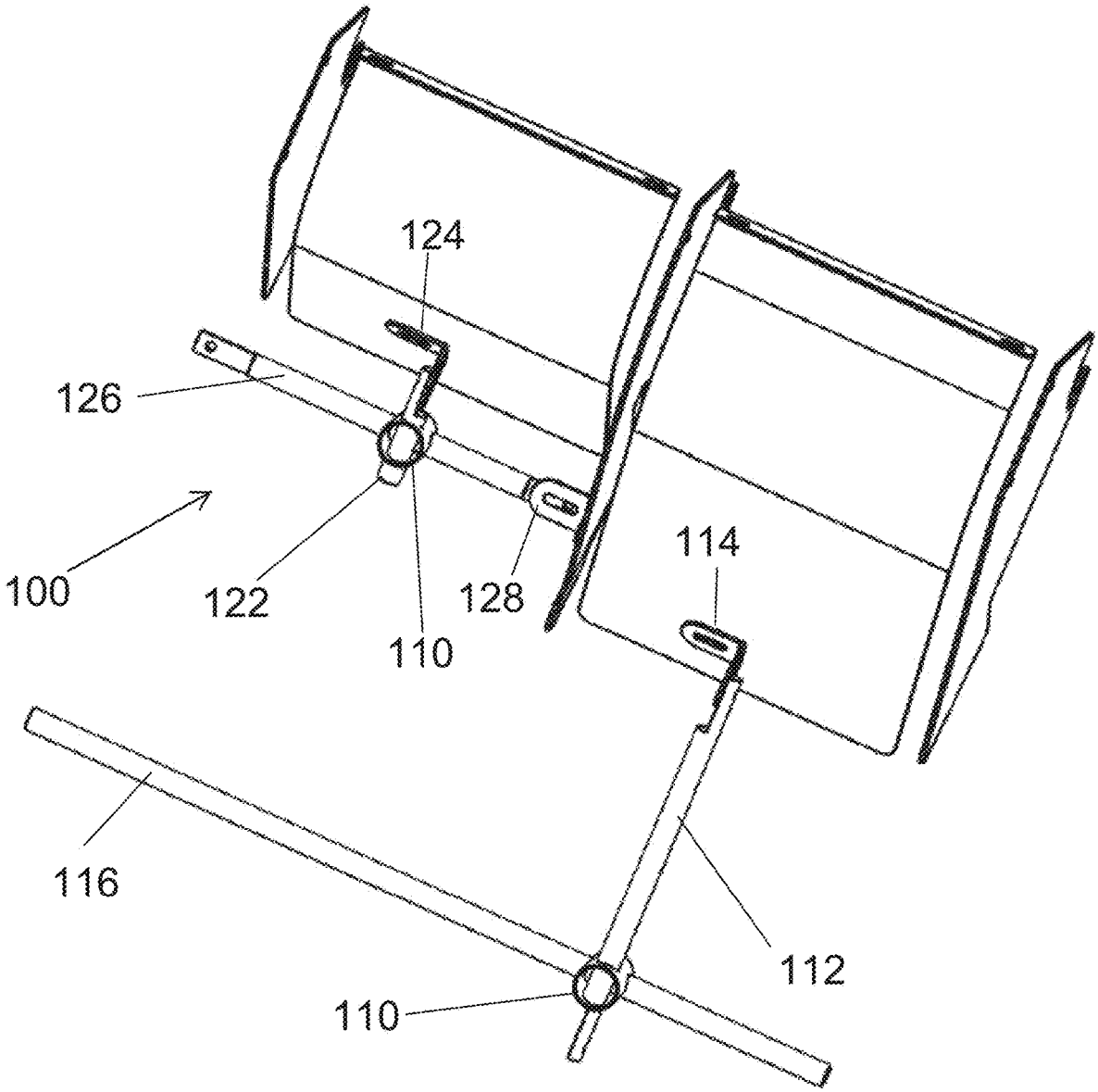
FIG. 6 illustrates a rear perspective view of the container guide with the container guide alignment mechanism.

FIG. 6 illustrates a rear perspective view of the container guide alignment mechanism 100 of FIG. 5. The second component 112 is illustrated as being connected to the slide 80 at a bracket 114. The second component 122 is illustrated as being connected to the slide 80 at a bracket 124.

Figure 7:
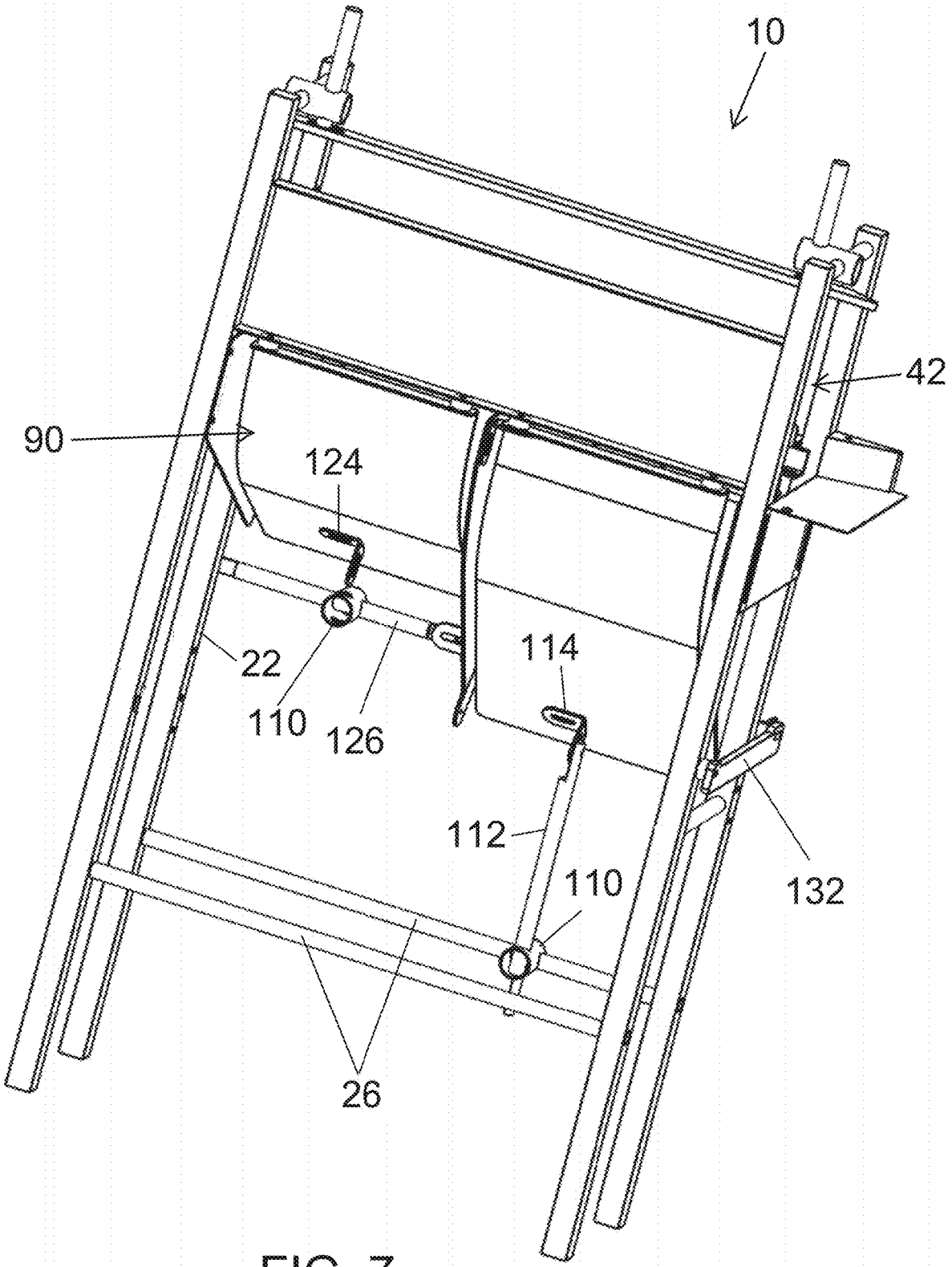
FIG. 7 illustrates a rear perspective view of the case loader with the container guide alignment mechanism of FIGS. 5-6.

FIG. 7 illustrates a rear view of the case loader 10 with the container guide alignment mechanism 100 of FIGS. 5-6 and further illustrates that the first component 110 is mounted on the third member 26 of the frame 20. The container guide alignment mechanism 100 of FIGS. 5-6 may be installed on case loaders already in use, as a retrofit.

Figure 8:
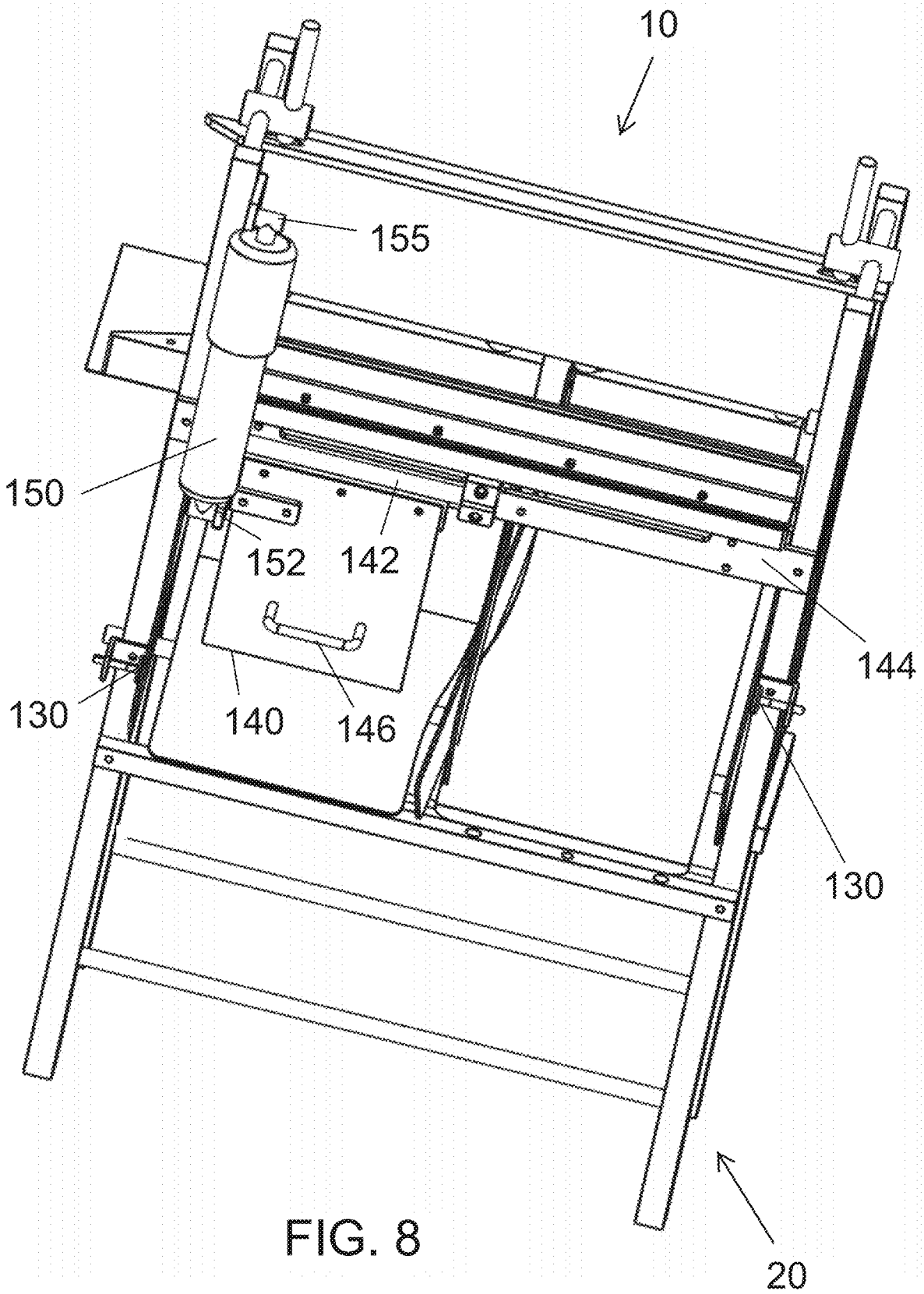
FIG. 8 illustrates a front perspective view of a case loader.

FIG. 8 illustrates a perspective view of the case loader 10 with the container guide of FIGS. 3-4 and with an optional slide component 140 to assist in slowing a velocity of a sliding movement of the container before the container drops into the case. Such slide component 140 is illustrated as being pivotally attached to the frame and connected to an actuator that may be also attached to the frame 20 at a pivot 142 connected to the support 144. The support 144 is connected to the frame 20. A handle 146 may be attached to the slide component 140. The handle may be used to manually move the slide component 140. An actuator 150, that may be a damper, is pivotally attached to the slide component 140 at a pivot 152 and is pivotally attached to the frame at a pivot 155. The actuator 150 returns the slide component 140 into a position to contact a container, after previous container contacts the slide component 140 and pushes the slide component 140 outwardly due to a momentum generated during the sliding movement of the container toward the case. The slide component 140 may be referred to as a deflector.

Figure 9:
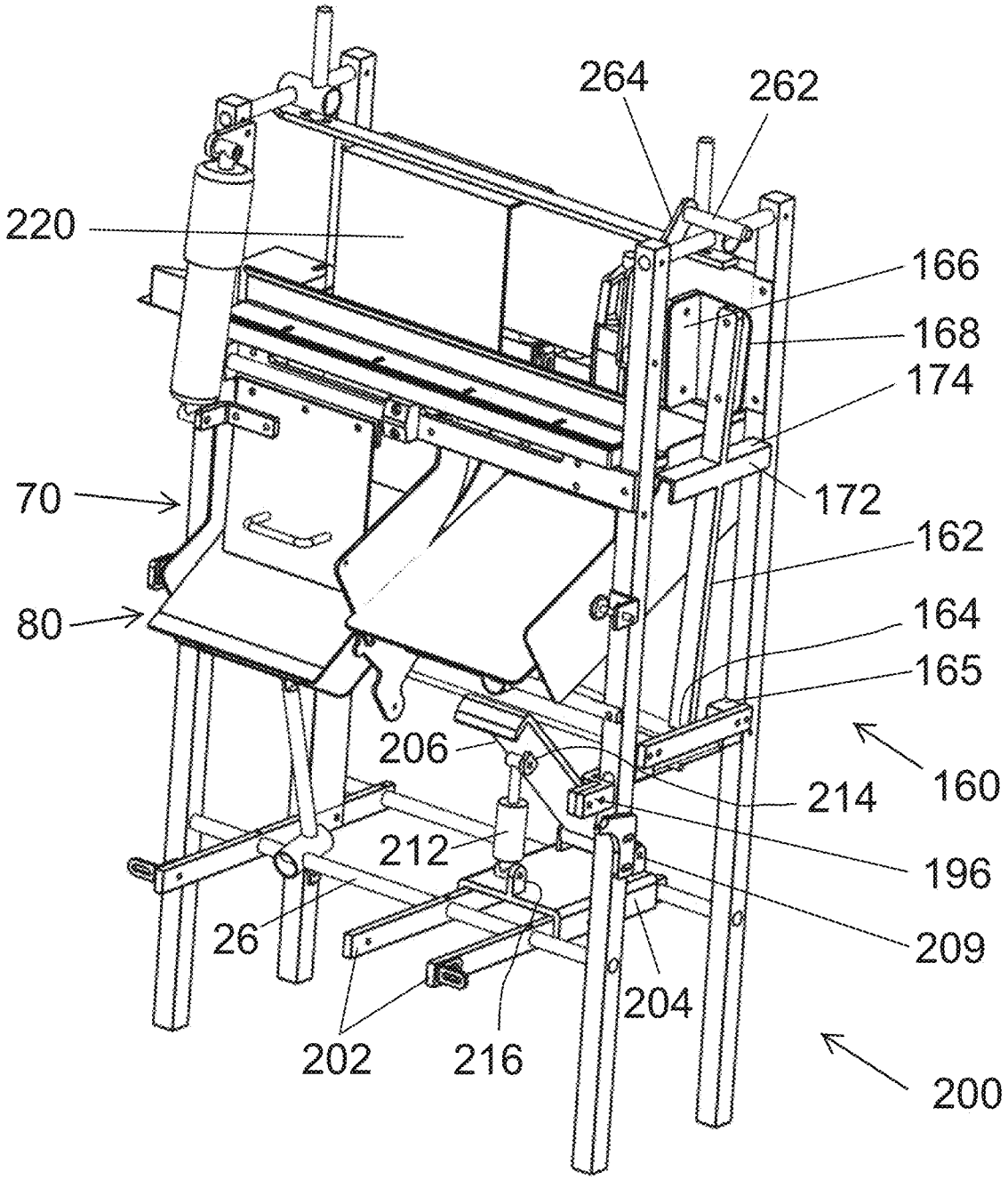
FIG. 9 illustrates a front perspective view of a case loader.

FIG. 9 illustrates a perspective view of the case loader 10 with the container release 160. The container release 160 is designed with a container sensor arm 162 that is in a pivot connection with the frame 20 at a pivot 164 with pivot blocks 165. A container sensor 166 is designed as a stop to contact a surface of a leading container 2 received within the container station 40. The container sensor 166 may be adapted with a flange 168 which is designed to be adjustable mounted on the container sensor arm 162, for example with apertures and fasteners. The container sensor arm 162 may be referred to as a first arm. A surface 174 is defined on the container sensor arm 162. The surface 174 may be within a ledge support 172 attached to the container sensor arm 162 mediate its ends or its end portions. The surface 174 provides a support for the ledge 46 and may be referred to as a ledge support 172. The ledge support 172 maintains the ledge 46 in the container receiving position and allows pivoting of the ledge 46 into the container release position upon pivoting of the container sensor arm 162. A case sensor 196 is also illustrated.

FIG. 9 further illustrates a case assist device 200 that is designed as a device to prevent unintended tilting of the case 4 being loaded into a case discharge position. This case assist device 200 may be referred to as a case restraint. The case restraint 200 may be designed with an arm 206 with a flange 208 at one end of the arm 206. A first pivot connection 209 is provided between an opposite end of the arm 206 and the frame 20. The first pivot connection 209 may be on a mounting component 204 that is supported on the frame 20 by a pair of supports 202, which in turn nay be attached to the third members 26. An actuator 212 is also provided. A second pivot connection 214 is between the actuator 212 and the arm 206. A third pivot connection 216 is between the actuator 212 and the frame 20 via the mounting component 204. The actuator 212 is operable to pivot the arm 206 between a case engaging position where the flange 208 contacts an edge of the case and prevents tilting of the case 4 and a case release position where the flange 208 is disposed at a distance from the edge of the case 4 and allows tilting of the case 4. The case assist device 200 may be also referred to as a case tilt prevention device or as a means for preventing unintended tilt of the case being loaded with containers. The container guide insert 220 is also being illustrated as positioned at the slide 80.

FIG. 10 illustrates a partial end view of the case loader 10, particularly illustrating the container release 160. The ledge 46 is adapted with block 170 that disposed on the surface 174. When the container 2 advances in a direction 3 and contacts the container sensor 166, the container 2 continues such movement to pivot the container sensor arm 162 into a position 162'. Since the surface 174 is rigidly attached to the container sensor arm 162, the surface 174 moves; into a position 174'. When the container sensor arm 162 pivots into the position 162', the block 170 is no longer supported on the surface 174 and is free to move in a downward direction 171. The block 170 may be replaced by a roller. Roller may reduce frictional forces during operation.

FIG. 11 illustrates a partial end view of the case loader 10 with the container release 160 and with the first ledge 46 in a support position when the block 170 and the first ledge 46 are supported on the surface 174. Counterbalance 178 is also illustrated. The second support 54 prevents sliding of the container 2 from the ledge 46.

FIG. 12 illustrates a partial end view of the case loader 10 with the container release 160 and with the first ledge 46 being in a partially tripped position by pivoting about the pivot 176. In this position, the container 2 is still supported on the ledge 46 but is now free to slide from n the first ledge 46. The top of the container 2 is no longer being supported by the second support 54.

FIG. 13 illustrates the case loader 10 with the container release 160 and with the first ledge 46 in a fully tripped position. In this position, the container 2 is not being supported on the first ledge 46 and is free to move (drop) downwardly.

Figure 14:
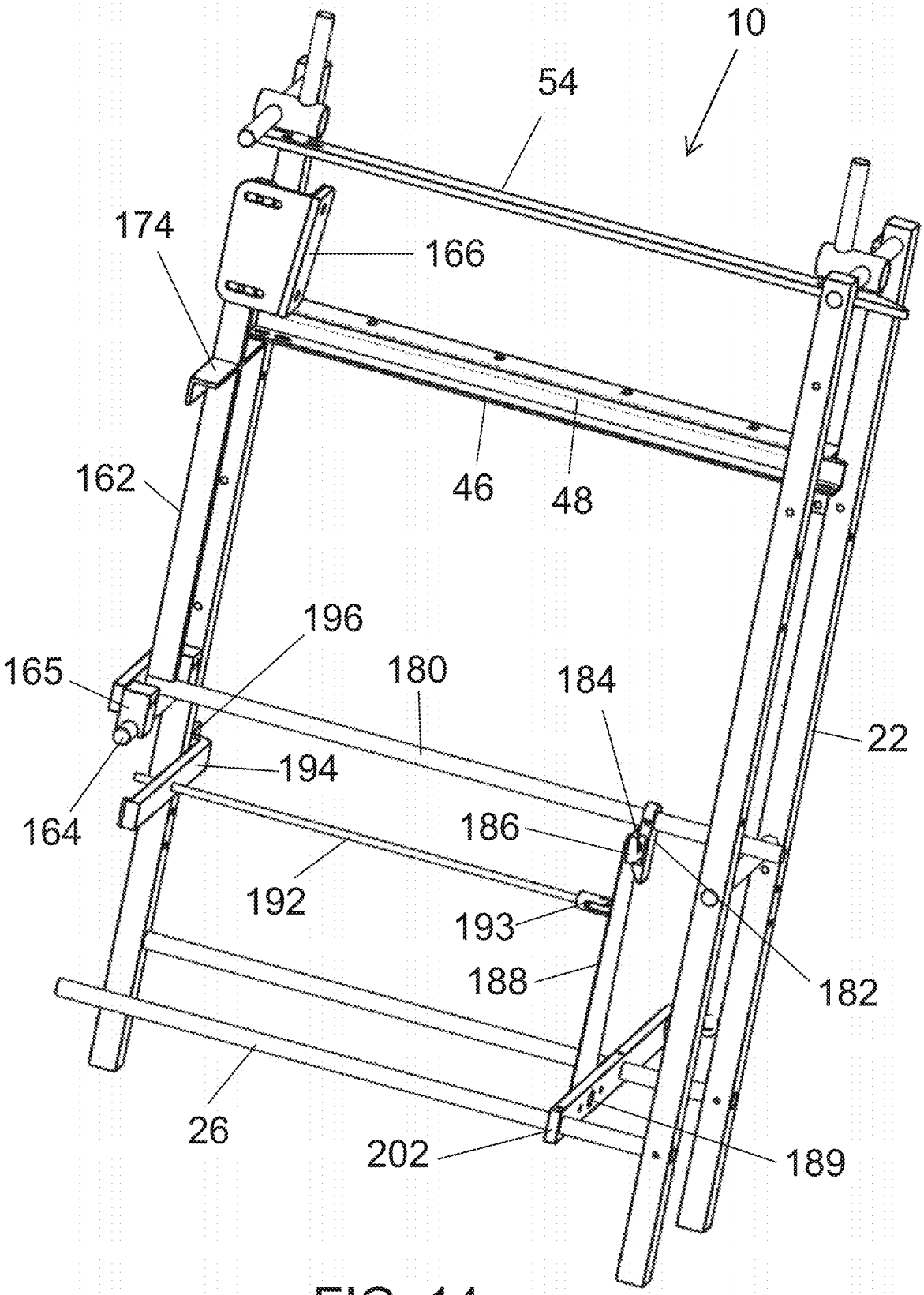
FIG. 14 illustrates a rear partial perspective view of the case loader, particularly illustrating a container sensor, a case sensor, a latch and a linkage connecting the case sensor with the container sensor.

FIG. 14 illustrates a rear partial perspective view of the case loader 10, particularly illustrating the case sensor 196 and a latch with a linkage for the container release 160. The pivot 164 and the pivot blocks 165 are also illustrated. A latch 182 is connected to the container sensor arm 162 through a connecting component 180. The connecting component 180 may be a solid rod. The connecting component 180 may be a hollow tube. The latch 182 is designed with a surface cavity 184. A latch target 186 is mounted on one end of an arm 188. The latch target 186 is sized and shaped to be received within the surface cavity 184. The latch target 186 being selectively retained within and released from the latch 182. The latch target 186 being released from the latch 182 to allow a movement of the container sensor arm 162. The arm 188 has a connection, at an opposite end, to the frame 20, for example to the support 202. The connection may be a pivot connection 189. In other words, the opposite end may be connected to the support 202 with a pivot 189. The connection may be a rigid connection. In other words, the arm 188 may be rigidly connected to the support 202 and may be made flexible enough for the end with the latch target 186 to move from the surface cavity 184. The arm 188 is further connected, mediate ends thereof, to a case sensor arm 194 with a linkage 192. The case sensor 196 is connected to the case sensor arm 194. The case sensor arm is pivotally connected to the frame 20 at a pivot 199. The linkage 192 may be provided as an adjustable linkage. For example, a threaded connection may be designed between the linkage 192 and a clevis 193 that is connected to the arm 188. The clevis 193 may be provided in a pivotal connection with the arm 188.

In view of the above, the first support 46 with the flange 48, the pivot 176 and the counterbalance 178 may be provided as a component (sub-assembly) of the container release 160.

Figure 15:
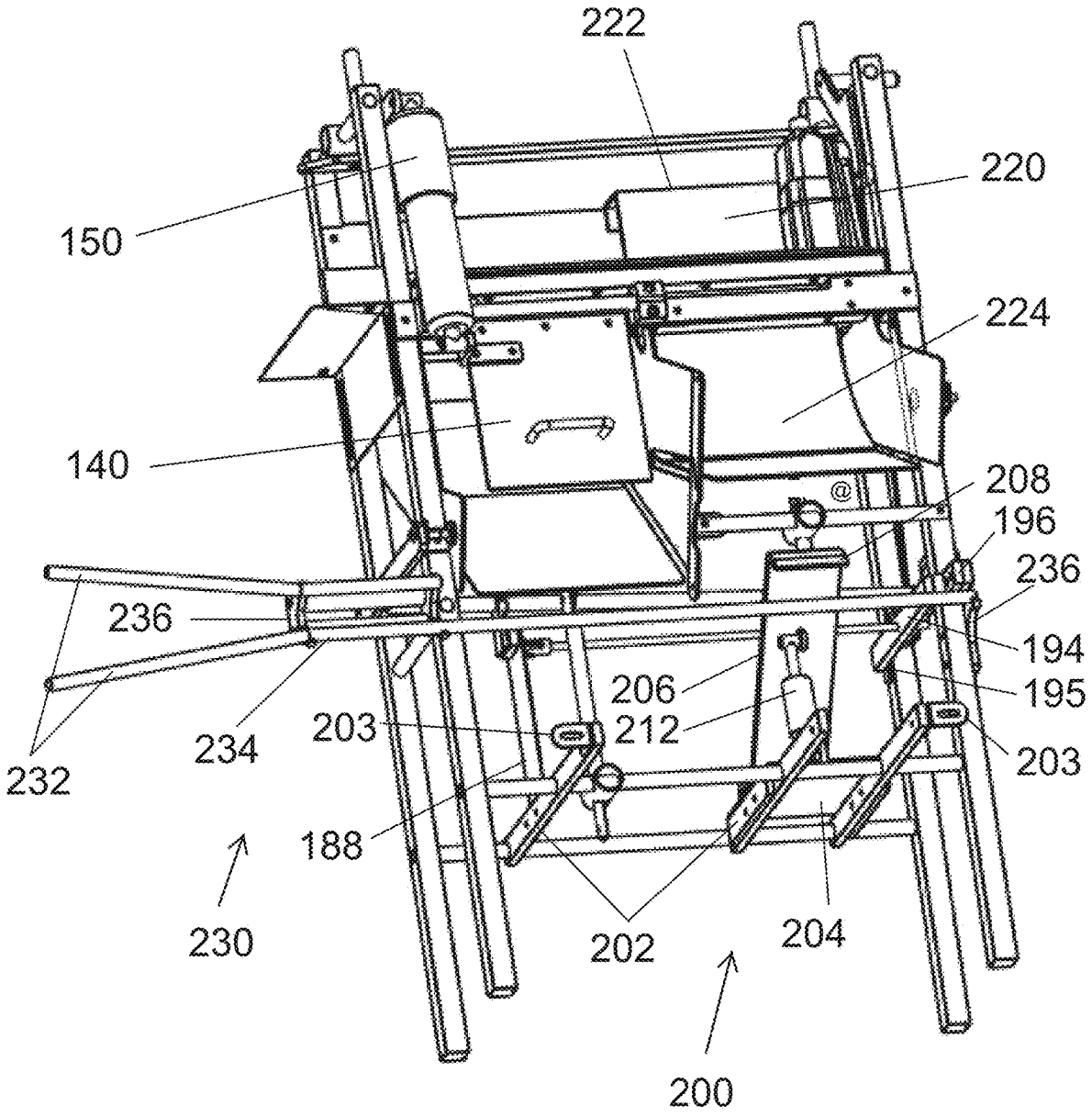
FIG. 15 illustrates a perspective view of a case loader.

FIG. 15 illustrates a perspective view of the case loader 10. FIG. 15 illustrates the container guide insert 220 within the slide 90. The container guide insert 220 has a container facing edge 222 and a case facing edge 224. The container facing edge 222 is connectable to the frame 20. The container facing edge 222 may be sized and shaped to rest on the panel 28. The container facing edge 222 may be sized and shaped to rest on a cross brace within the frame 20. The container facing edge 222 may be designed with a flange to hook onto a portion of the frame 20, including the panel 28. The container guide insert 220 may be sized to position the case facing edge 224 at or adjacent the surface of the slide 90. The container guide insert 220 may be sized to position the case facing edge 224 at a distance from the surface of the slide 90. When loading (casing) half-gallon containers through two slides 80, 90, the container guide insert 220 is provided at each slide. In view of the above, the container guide insert 220 may be easily removed to configure the case loader 10 to load one-gallon containers.

FIG. 15 also illustrates a case guide 230 that may be used with the case loader 10. The illustrated case guide 230 comprises two first guides 232 that are disposed at an incline to the second guide 234. The pair of first guides 233 are positioned external to the frame 20 in a direction of advancing cases. The second guide 234 is mounted across the frame 20. The second guide 234 may be supported by supports 236 that are rigidly attached to the uprights 22. FIG. 15 further illustrates brackets 203 that may be used to attach frame 20 to a case station 240 of FIG. 16.

Figure 16:
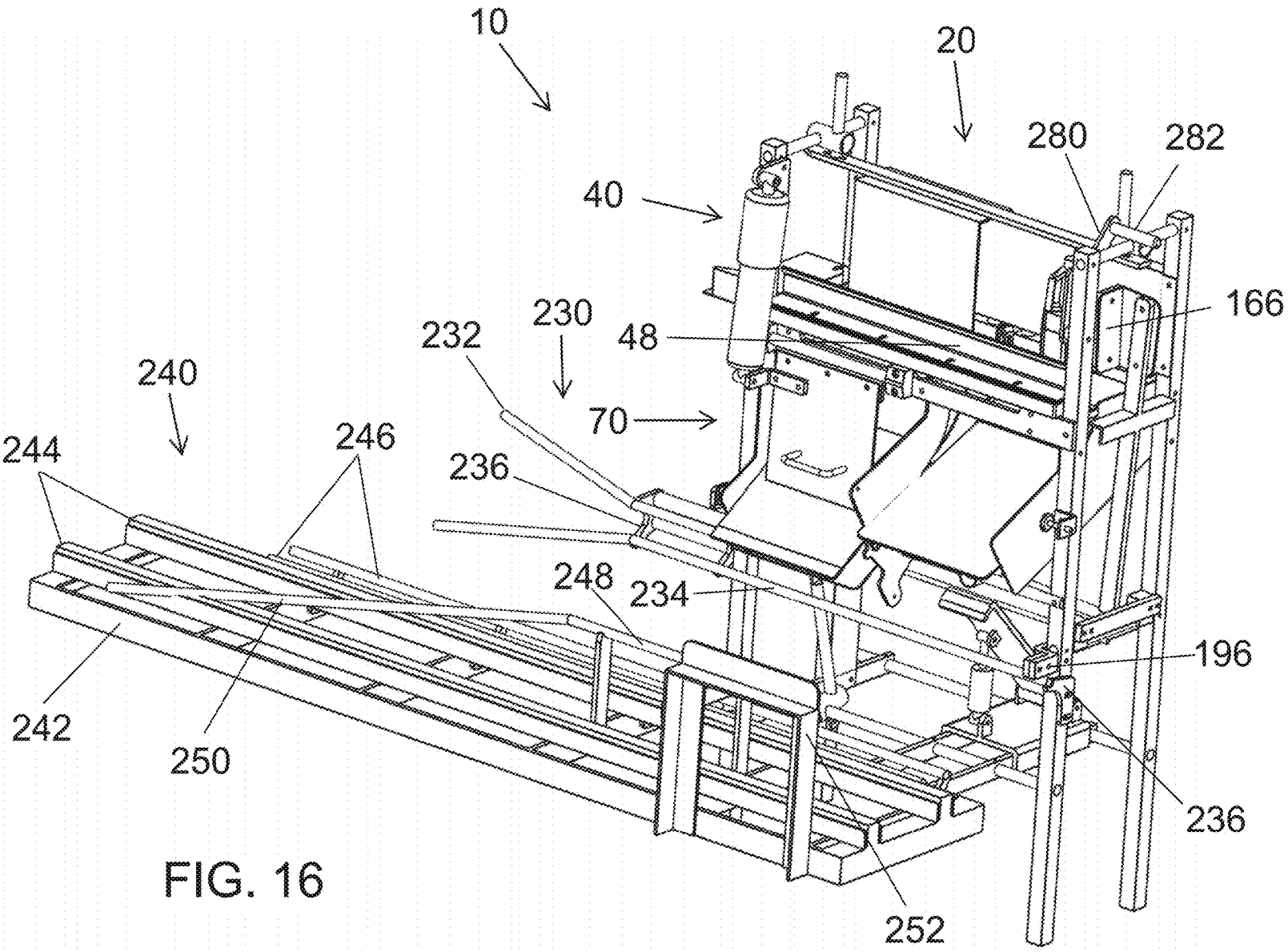
FIG. 16 illustrates a front perspective view of a case loader with a case station.

FIG. 16 illustrates a perspective view of the case guide 230 and with the case station 240 that may be used with the case loader 10. The case station includes a base 242 and a conveyor portion 244 which is positioned on the base 242 and which is aligned with a case conveyor (not shown). Two first case guides 246 are mounted on the base 242, in a parallel alignment with each other, and adjacent the frame 20. A second case guide 248 is mounted at a greater distance from the base 242 and above the two first case guides 246. The second case guide 248 is also mounted parallel to the second guide 234. A third case guide 250 has one end adjacent the base 242 and a second end adjacent an end of the second case guide 248. The third case guide 250 is disposed at an inclined to each of the base 242, the second case guide 248, and the second guide 234. The third case guide 250 may be referred to as an inclined bar 250 Case stop 252 is also illustrated as being upstanding on the base 242. Frame 20 is illustrated with threaded portions 256 that may be used to adjust the frame 20 in a vertical direction.

FIG. 16 further illustrates a safety latch 280 in a pivotal connection with the frame 20. The safety latch 280 when pivoted into a position in a contact with or being adjacent to the flange 48 prevents an unintended pivoting of the ledge 46. A handle 282 may be attached to the safety latch 280 for ease of use. The safety latch 280 may be used during a maintenance procedure or to clear up a jam of containers without a concern of container 2 accidentally releasing from the container station 40.

Figure 17:
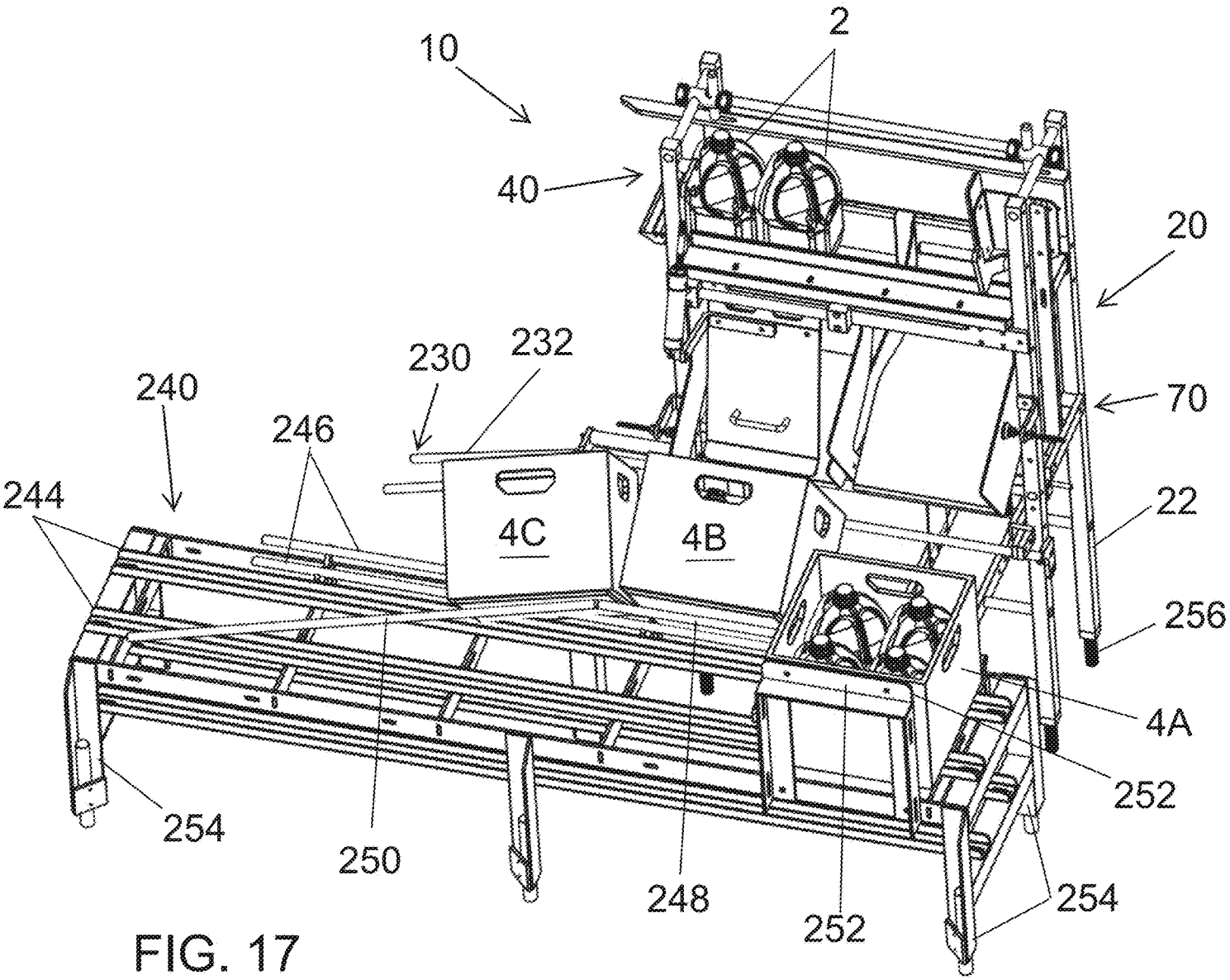
FIG. 17 illustrates a front perspective view of a case loader with the case station.

FIG. 17 illustrates a perspective view of the case guide 230 and the case station 240 in a combination with the case loader 10 designed to load two cases 4 at two slides 80 and 90. The base 242 is being illustrated as upstanding on legs 254. FIG. 17 also illustrates three cases 4, referenced for the sake of clarity as 4A, 4B and 4C. Case 4A is illustrated in a case discharge position. The case discharge position defines both a fully loaded condition of the case 4A and also defines an upright position of the case 4A. Case 4A is aligned with the slide 90 and contacts the case sensor 196 prior to being pivoted into the case discharge position from a case loading position. The second case guide 248 terminates prior to the case discharge position to allow pivoting of the case 4A from the case loading position into the case discharge position due to a momentum from a final tier of container 2 received within the case 4A. In the case discharge position, the case 4A rests on the conveyor portion 244 and may rest against the case stop 252.

Case 4B is illustrated in a case loading position and being aligned with the slide 80. The case loading position defines an inclined condition of the case 4B. The case 4B is supported in a following manner. A bottom wall is supported on the second case guide 248. A side wall is supported on the second guide 234. An edge between the bottom wall and the side wall is received in a space between the two first guides 232. Case 4B may be referred to as being partially loaded.

Case 4C is illustrated in a case advancing position. In this case advancing position, a bottom wall is supported on the third case guide 250 and a top edge is received within a space between the two first guides 232.

Figure 18:
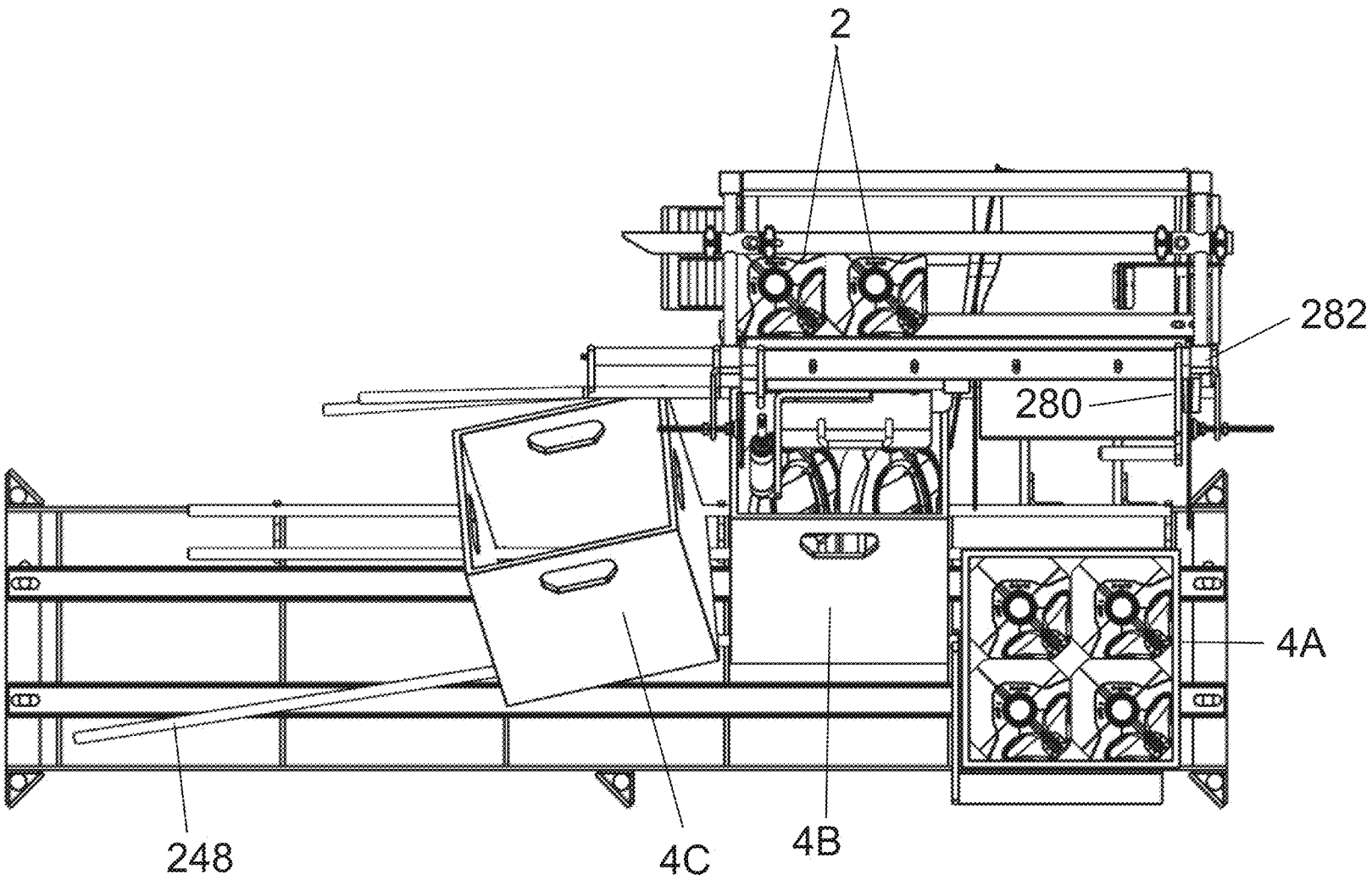
FIG. 18 illustrates a top view of the case loader with the case station of FIG. 17.

FIG. 18 illustrates a top view of the case guide 230 and the case station 240 of FIG. 17. FIG. 18 further illustrates a case 4A loaded with four containers 2. The container 2 may be of a one-gallon milk or juice jug type.

FIG. 19 illustrates a diagram of a case assist device 260 designed to relieve a back pressure onto the case 4 from the cases 4 advancing on the case conveyor (not shown) with a linearly moving tapered block 262 attached to an actuator 264. This case assist device 260 may be attached to the frame 20 adjacent the first slide 80. This case assist device 260 may be attached to a support structure adjacent the frame 20 and adjacent the first slide 80, for example in a position above case 4A or 4B.

FIG. 20 illustrates a diagram of a case assist device 260 designed to relieve a back pressure onto the case 4 from the cases 4 advancing on the case conveyor (not shown) with a rotating arm 266 attached to and being rotatable by an actuator 268. Actuator 268 may be provided as a rotary solenoid. This case assist device 260 may be attached to the frame 20 adjacent the first slide 80. This case assist device 260 may be attached to a support structure adjacent the frame 20 and adjacent the first slide 80.

FIG. 21 illustrates a diagram of a device 270 with as an actuator 272 contacting a surface of the case 4 or an arm 274 rotatable by an actuator 276. Actuator 276 may be provided as a rotary solenoid. In this design, the device 270 functions as a case assist device 270 designed to assist tilting of the case into a case discharge position. The actuator 272 may be mounted in a location of the actuator 212 to assist tilting of the case into the case discharge position. The actuator 272 may be mounted opposite to the location of the actuator 212 to prevent unintended tilting of the case into the case discharge position. This opposite location may be adjacent the case stop 252. In this arrangement, the device 270 may be used as the case restrain or as the case tilt prevention device instead of the case assist device 200, as described above. In this arrangement, the device 270 may be used as the case assist device or as a means for preventing unintended tilt of the case 4 being loaded.

FIG. 22 illustrates a bloc diagram of an exemplary control circuit or a control unit 300 that can be used with the case assist device, as described above. Outputs from a timer 302 are electrically coupled to solenoids 304 to actuate and deactuate the actuator, a power source 306 that may be a voltage reducing transformer or a source of power, and a photo eye 308. A selector switch 310 may be included to turn on/off features and/or functions.

Figure 23:
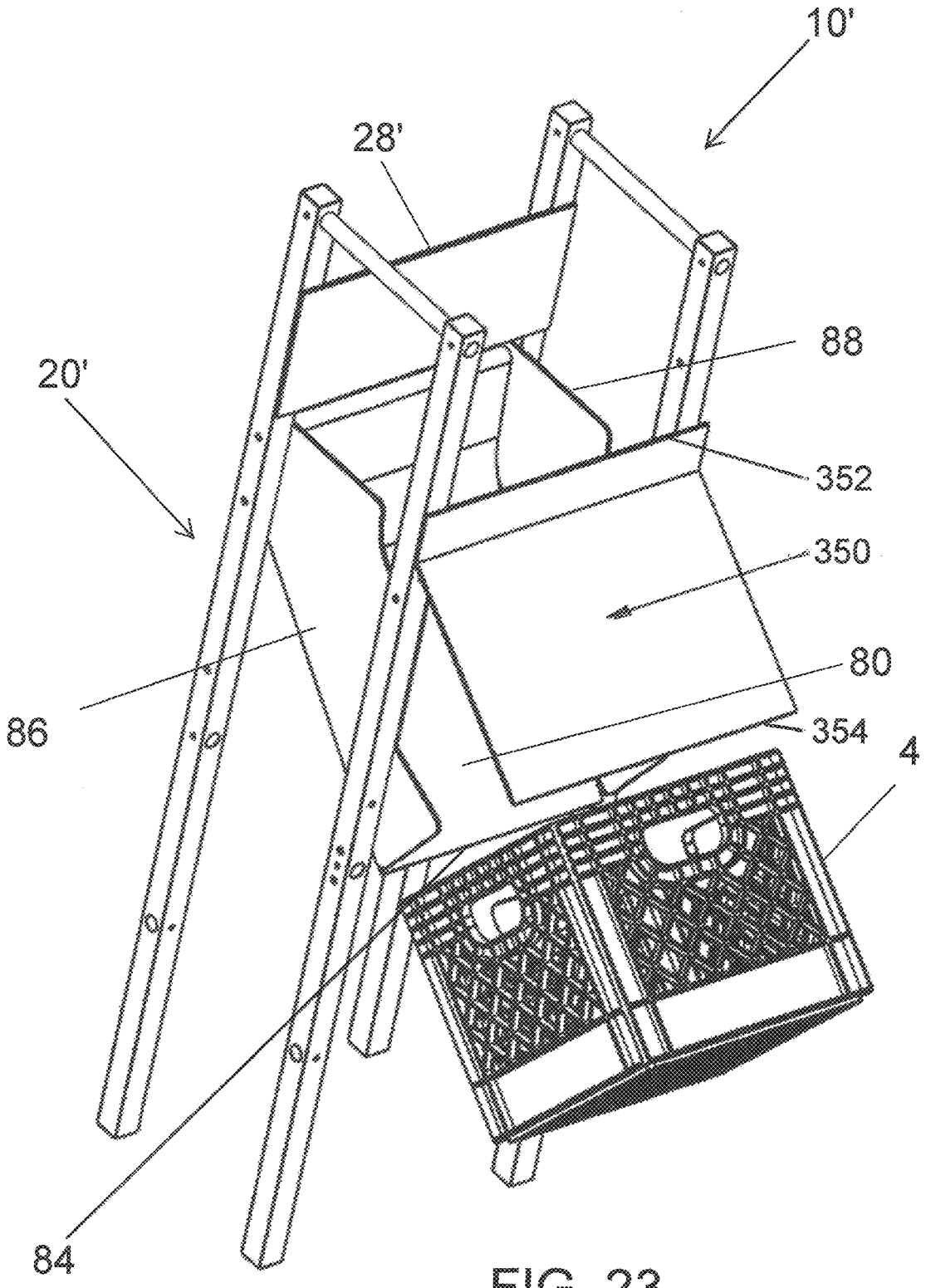
FIG. 23 illustrates a partial perspective view of a case loader.

FIG. 23 illustrates a case loader 10' designed with a frame 20'. The frame may be constructed similar to the above described frame 20 but may be made smaller with uprights joined by a panel 20'. The case loader 10' is also designed with a single slide that may be the above described slide 80 with two side walls 86 and 88. This case loader 10' may be used to load one container 4 at a time. The container guide alignment mechanism 100 (not shown in FIG. 23), may be designed as a power actuated device, for example such as the actuator 212 described above and may be controller to move the slide 86 in a vertical direction to load the container 2 into tiers into the case 4. A component 350 has one edge 352 attached to the frame 20 and has another edge 354 positioned above the case facing edge 84. The component 350 is positioned above the chute and extends in a direction of the slide (bottom wall) 80.

Figure 24:
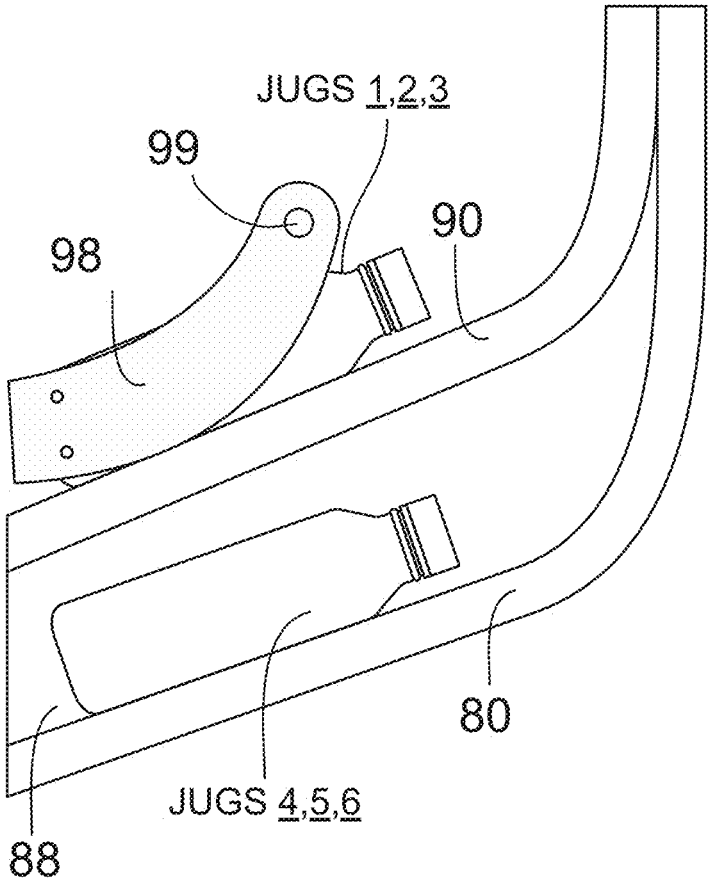
FIG. 24 illustrates a partial view of the case loader.

FIG. 24 illustrates a partial view of the case loader, particularly illustrating slides 80, 90. The optional side 98 may be mounted, either directly or indirectly, on the frame 20 at a pivot 99. The optional side 88 is also illustrated. FIG. 24 also illustrates containers 2 as half-gallon jugs numbered as 1, 2, 3 to reference containers 2 received at the container sensor 166 for loading a second tier into a partially loaded case 4 through the upper slide 90 and numbered as 4, 5, 6 to reference containers 2 for loading a first tier within the case 4 through the lower slide 80.

Figure 25:
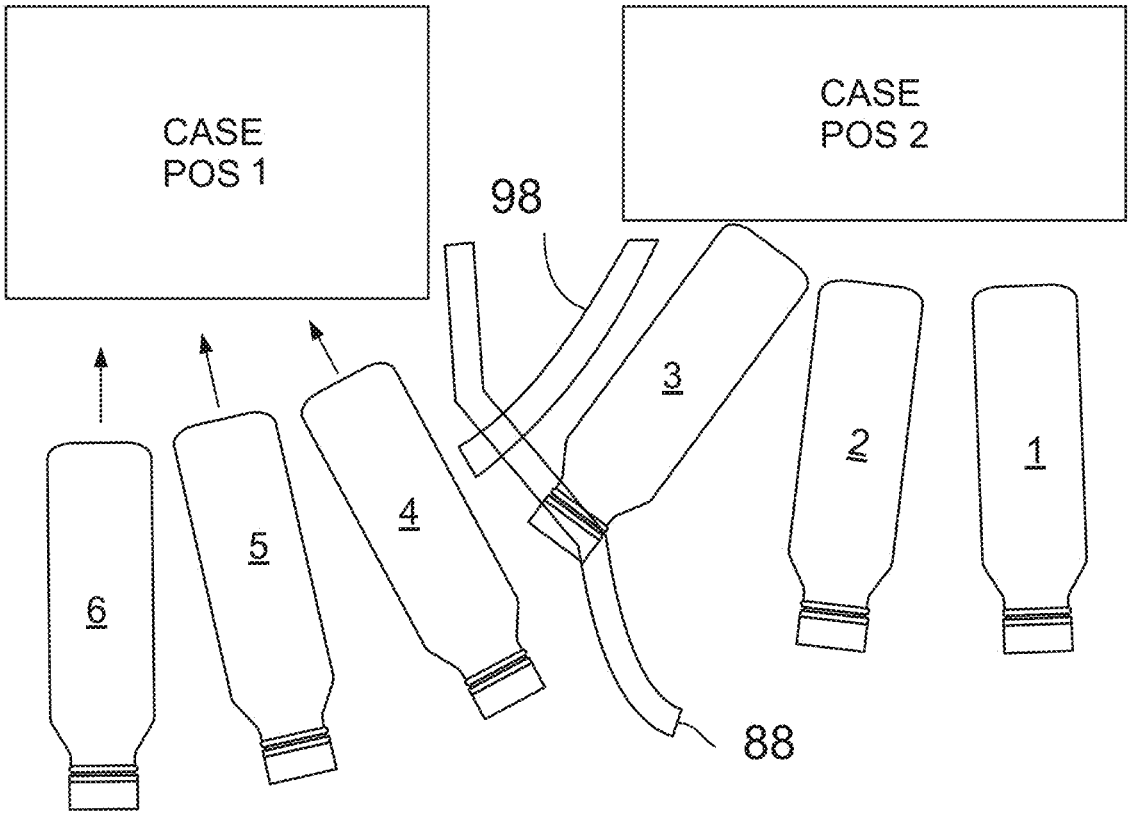
FIG. 25 illustrates a diagram of loading six half-gallon jugs.

FIG. 25 illustrates a diagram of loading the six half-gallon jugs received within the container station 40 in a single row into two cases 4 positioned in a side-by-side relationship with each other. "Pos Case 2" indicates a position of the case 4 to receive the first tier of containers 2. "Pos Case 1" indicates a position of the case 4 to receive the second tier of containers 2. FIG. 25 further illustrates angled position of the optional sides 88 and 98 to accommodate size expansion and contraction of the containers 4 during a sliding movement from the container station 40 into the cases 4.

Now, operation of a case loader 10 will be explained in view of the Drawings and in greater details on an example of the case loader designed to load four containers, received in a single column, through two slides into two tiers within a single case.

The containers 2 are continuously conveyed by the container conveyor across tray 60 to the container support system within the container station 40. The following containers 2 urge the four leading containers 4 to slide across the first ledge 46 and the second ledge 55 until the lead container 2 strikes container sensor 166.

If a case 4 is not in a position to be loaded, the latch target 186 prevents the latch 182 from moving and the four containers 2 remain on ledge 46, which is held in the horizontal position by block 170 resting on ledge support 172.

The cases 4 are pushed along the case conveyor by the following cases and engage the conveyor portion 244. The case station 240 and the case guide 230 are designed such that when the case 4 contacts the third case guide 250, the case 4 begins to tilt toward the frame 20, while being in a contact with the two first guides 232. As the case 4 approaches a first loading position at the slide 80, it is tilted beyond a dead center. When the case 4 moves into the first loading position at the slide 80, now being tilted and supported by the two first case guides 246, the second guide 234 and the second case guide 248. The case 4 continues to advance, pushed by the back cases, until it reaches the second loading position at the slide 90 and strikes the case sensor 196.

When the leading case 4 (case 4A in FIGS. 17-18) strikes the case sensor 196, the case sensor arm 194 will pivot toward the frame (to the left in FIG. 14) and disengage latch target 186 from the surface cavity 184 of the latch 182 through the linkage 192. The case 4 needs to only move the case sensor arm 194 enough to allow the latch target to disengage from latch 182, thus allowing the container sensor arm 162 to pivot freely (see further FIG. 10).

When the container sensor arm 162 pivots, the block 170 falls off of the ledge support 172, thus pivoting the first ledge 46 to a vertical position and releasing the containers 2 (see further FIGS. 11-13). Each of the four containers 4 falls against the panel 28 or against rear portions of the slides 80 and 90. The two containers 2 above the lower slide 80 may first strike the deflector 140 which serves to guide them and to limit their velocity to guard against denting the containers 2.

The two containers 2 which go through the lower slide 80 to the trailing case (4B) form the lower course in that case. The two containers 2 which go to the leading case (4A) through the upper slide 90 form the upper course in the leading case (4A). These two containers have sufficient momentum to tip or tilt the case 4A, or pivot it around the second case guide 248 back onto the conveyor portion 244, into the case discharge position, which removes the case 4 from the case loader 10.

Immediately after the containers 2 fall from the container support system, the container sensor arm 162 will be biased back to its original position by weight of linkage 192. It is prevented from returning to that position because block 170 is now riding on the ledge support 172. When the containers 2 have fallen below the ledge 46, counterbalance 178 will bias the ledge 46 back to the horizontal position, thus bringing the block 170 back up above ledge support 172 and allowing the case sensor arm 194 with the case sensor 196 to return into the original position to sense another case 4 that is now advancing on the case conveyor.

Although, the design of the case loader 10 has been illustrated in various Figures with the containers 2 and cases 4 moving from left to right the design of the case loader 10 can be mirrored to accommodate movement of containers 2 and cases 4 from right to left.

This document incorporates by reference U.S. Pat. No. 4,428,178 issued to Burtoft on Jan. 31, 1984, in its entirety.

EMBODIMENTS

Embodiment A

A case loader comprises a frame; a container station configured to receive containers therewithin; a container release; and a container guide under the container station, the container guide being sized and shaped to gravity load containers, received within the container station and released with the container release, into a case though an open end thereof, the case being positioned at an incline relative to a case discharge position with the open end facing the container guide.

A feature of this embodiment is that the container guide comprises a cross-sectional shape in a plane normal to a container sliding direction being complimentary to a shape of a peripheral surface of a container.

A feature of this embodiment is that the container guide comprises two sides disposed at a distance from each other and a slide component positioned within the distance between the two sides.

A feature of this embodiment is that the slide component comprises a curved shape.

A feature of this embodiment is that the slide component comprises a case-facing portion being adjustably movable in a vertical direction.

A feature of this embodiment is that the container guide is designed to position a case facing edge proximal to the open end of the case.

A feature of this embodiment is that the container guide comprises three sides disposed at a distance from each other and in a series with each other along a case movement direction and two slide components, each slide component being positioned within a distance between two sides.

A feature of this embodiment is that the container guide comprises two chutes disposed adjacent to each other along a case movement direction, each chute from two chutes comprises two side walls and a bottom wall, the bottom wall comprising a container facing edge and a case facing edge.

A feature of this embodiment is that at least one chute from the two chutes is designed with an adjustable bottom wall.

A feature of this embodiment is that at least one chute from the two chutes is designed with an adjustable side wall.

A feature of this embodiment is that a side wall of one chute crosses over a side wall of another chute.

A feature of this embodiment is that the two side walls and the bottom wall in the each chute are designed to mount to the frame without attachment between each other.

A feature of this embodiment is that the case loader further comprises a device with a first portion adjustably mounted on the frame and a second portion designed to contact a side wall, the first portion is adjustably moveable to move the side wall toward to and away from an edge of the bottom wall.

A feature of this embodiment is that the case loader further comprises a device with a first component mounted on the frame a second component comprising one end connected to the bottom wall and a threaded connection between the first component and the second component, the second component designed to move the case facing edge of the bottom wall between the two side walls.

A feature of this embodiment is that the container facing edge is designed to be attached to the frame.

A feature of this embodiment is that the container station comprises an adjustable container support.

A feature of this embodiment is that the container release comprises a container sensor; a first arm with one end portion attached to the container sensor; a first pivot pivotally attaching another end portion of the first arm to the frame; a case sensor; a second arm with one end portion attached to the case sensor; a second pivot pivotally attaching another end portion of the second arm to the frame; a latch connected to the first arm; a latch target connected to the second arm, the latch target being selectively retained and released by the latch, the latch target being released by the latch to allow a movement of the first arm; a ledge positioned adjacent the container station, the ledge designed to receive a bottom of a container thereon; a third pivot pivotally connecting the ledge to the frame for pivoting between a container receiving position and a container release position; a ledge support attached to the first arm mediate the end portions, the ledge support maintaining the ledge in the container receiving position and allowing pivoting of the ledge into the container release position upon pivoting of the first arm; and a counterweight attached to the ledge so as to return the ledge into the container receiving position.

A feature of this embodiment is that the container release comprises a case sensor; a container sensor; and a latch assembly between the case sensor and the container sensor.

A feature of this embodiment is that the case sensor comprises a case stop; and a pivotal connection between the case stop and the frame.

A feature of this embodiment is that the container sensor comprises a container stop; and a pivotal connection between the container stop and the frame.

A feature of this embodiment is that the latch assembly comprises a latch connected to the case sensor; an arm with one end portion attached to the container sensor; a pivot pivotally attaching another end portion of the arm to the frame; and a latch target connected to the arm, the latch target being selectively retained and released by the latch, the latch target being released by the latch to allow a movement, through the arm, of a container support between a container receiving position and a container release position.

A feature of this embodiment is that the case loader further comprises a case assist device.

A feature of this embodiment is that the case assist device comprises an actuator configured to generate a pivoting movement; and an arm connected to the actuator for the pivoting movement, the arm being shaped and sized to contact an edge of the case being positioned further from the frame and being aligned with a case discharge direction, the arm pulling the case, being fully loaded with containers into the case discharge position due to the pivoting movement generated by the actuator.

A feature of this embodiment is that the case assist device comprises an actuator configured to generate a pivoting movement; a support connectable to the frame and to the actuator, the support extending outwardly from the frame in a direction of the case when support connected to the frame; and an arm connected to the support for the pivoting movement, the arm shaped and sized to contact a side edge of an adjacent case to the case being fully loaded so as to move the adjacent case a distance away from the case being fully loaded.

A feature of this embodiment is that the case assist device comprises a support connectable to the frame, the support extending outwardly from the frame in a direction of the case when support connected to the frame; an actuator mounted on a support, the actuator configured to generate a pivoting movement; and an arm connected to the actuator for the pivoting movement, the arm shaped and sized to contact a side edge of an adjacent case to the case being fully loaded so as to move the adjacent case a distance away from the case being fully loaded.

A feature of this embodiment is that the case assist device comprises an actuator configured to generate a rotational movement; and a roller connected to the actuator for the rotational movement, the roller positionable in a friction contact with a side surface of the case during operation of the case loader; the friction contact assisting the movement of a fully loaded case into the case discharge position during the rotation of the roller.

A feature of this embodiment is that the case assist device comprises an actuator configured to generate linear movement; and a stop connected to the actuator, the stop having a sloped surface; the case assist device being positioned so that the sloped surface contacts an edge of an adjacent case to the case being fully loaded so as to move the adjacent case a distance away from the case being fully loaded.

A feature of this embodiment is that the case assist device comprises an actuator configured to generate a linear movement in a vertical direction; and a stop connected to the actuator; the case assist device being positioned so that the stop contacts a surface of an adjacent case to the case being loaded so as to move the adjacent case a distance away from the case being loaded.

A feature of this embodiment is that the case assist comprises an arm with a flange at one end of the arm; a first pivot connection between an opposite end of the arm and the frame; an actuator; a second pivot connection between the actuator and the arm; and a third pivot connection between the actuator and the frame; the actuator operable to pivot the arm between a case engaging position where the flange contacts an edge of the case and prevents tilting of the case and a case release position where the flange is disposed at a distance from the edge of the case and allows tilting of the case.

A feature of this embodiment is that the case loader further comprises a sensor configured to sense a tier of containers positioned within the case and output a signal to a control circuit, the control circuit configured to operate the actuator to move the arm into the case release position.

A feature of this embodiment is that the container station comprises a first ledge designed to receive a bottom of a container thereon; a pivot, the pivot pivotally connecting the first ledge to the frame, where the first ledge pivots between a container receiving position and a container release position; a second ledge designed to support a top of the container received within the container station; and a counter balance, the counter balance extending from the first ledge.

A feature of this embodiment is that the container release comprises a case sensor; a latch target connected to the case sensor; a container sensor; an arm with one end portion attached to the container sensor; a pivot pivotally attaching another end portion of the arm to the frame; a latch connected to the arm, the latch being selectively retained and released by the latch target, the latch being released by the latch target to allow a movement of the arm; and a component attached to the arm mediate the end portions, the component designed to maintain a ledge in a container receiving position and allowing pivoting of the ledge into a container release position upon pivoting of the arm.

A feature of this embodiment is that the container station comprises a first movable container support; and a second movable container support.

Embodiment B

A case loader comprises a mounting component; an arm with a proximal end attached to the mounting component, the arm extending from the mounting component; a clevis pivotally attached to a distal end of the arm to pivot in a horizontal plane during operation of the case loader; and a bifurcated member pivotally attached to the clevis to pivot in a vertical plane during the operation of the case loader.

A feature of this embodiment is that the case loader further comprises a latch.

A feature of this embodiment is that the latch comprises a threaded member at a free end of each leg; and a bar pivotally attached to a first leg and releasably attached to a second leg.

A feature of this embodiment is that the latch comprises an external thread on a free end of each leg; and a bar pivotally attached to a first leg and releasably attached to a second leg.

A feature of this embodiment is that the latch comprises a threaded bore in a free end of each leg; and a bar pivotally attached, with a first fastener, to one leg and releaseably attached, with a second aperture, to another leg; the bar selectively connecting free ends of first and second legs.

A feature of this embodiment is that the case loader further comprises a case station positioned adjacent the frame, the case station designed to allow a pivoting movement of cases between an upright position and an inclined position.

A feature of this embodiment is that the case loader further comprises a container separator.

A feature of this embodiment is that the container separator comprises a block positioned and sized to compress two or more bottles at a beginning portion of a slide movement.

Embodiment C

A case loader comprises a frame; a container station; a container release; a slide positioned under the container station, the slide being sized and shaped to load, due to gravity and after containers are released with the container release, containers positioned within the container station into a case though an open end thereof, the case being in an inclined position relative to an upright position; a slide alignment component configured to align a case facing edge of the slide with an edge of a case being positioned, in the inclined position, next to the case facing edge of the slide.

A feature of this embodiment is that the container release comprises a pivotable container ledge; a pivotable container arm; a container sensor attached to the pivotable container arm; a pivotable case arm; a case sensor attached to the pivotable case arm; a linkage connecting the case sensor with the container sensor through the pivotable container arm and pivotable case arm, the linkage designed to pivot the pivotable container ledge in a response to sensing the case with the case sensor and sensing a container with the container sensor.

Embodiment D

A case loader comprises a container loading station for attachment to an end of a conveyor, the container loading station holding a case load of containers in a single column; a case loading station above a case conveyor for transporting cases to and away from the case loading station; the case loading station located beneath and to one side of the container loading station; a plurality of container slides between a bottom of the container loading station and the case loading station; each container slide beginning at a position of a different container and each ending at different container positions at the case loading station; a moveable container support in the bottom of the container loading station, the moveable container support holding the case load of containers when in a support position and allowing the case load of containers to fall by gravity when in a released position; a container sensor in the container loading station, the container sensor being activated by a leading container when slid into its position by other containers in the container loading station; a first stop means to hold the case load of containers in a position when the case load of containers has been conveyed to the container loading station; an inclined bar leading from beneath the case conveyor to above the case loading station to tilt the cases as they approach the case loading station; a means to hold a case in a titled position at the case loading station; a case sensor which is activated by the case when it reaches the case loading station; a second stop means to hold the case load of containers in the case loading station until the case load of containers has been loaded with containers; a means holding the moveable container support in a support position; a means operated by the container sensor and the case sensor in combination when both the containers and the cases are in their stations to disable the means holding the moveable container support in the support position; and a means for assisting a movement of fully loaded cases into a case discharge position.

Embodiment E

A case loader comprises a container loading station for attachment to an end of a conveyor, the container loading station holding a case load of containers in a single column; a case loading station above a case conveyor for transporting cases to and away from the case loading station; the case loading station located beneath and to one side of the container loading station; a plurality of container slides between s bottom of the container loading station and s case loading station; each container slide beginning at a position of a different container and each ending at different container positions at the case loading station; a moveable container support in the bottom of the container loading position, the support holding the containers when in the support position and allowing the containers to fall by gravity when in the released position; a moveable container support in a bottom of the container loading station, the moveable container support holding the case load of containers when in a support position and allowing the case load of containers to fall by gravity when in a released position; a first stop means to hold the case load of containers in a position when the case load of containers has been conveyed to the container loading station; an inclined bar leading from beneath the case conveyor to above the case loading station to tilt the cases as they approach the case loading station; a container sensor which is activatable by the case load of containers received within the container loading station; a means to hold a case in a titled position at the case loading station; a case sensor which is activated by the case when it reaches the case loading station; a second stop means to hold the case load of containers in the case loading station until the case load of containers has been loaded with containers; a means holding the moveable container support in a support position; a means operated by the container sensor and the case sensor in combination when both the containers and the cases are in their stations to disable the means holding the moveable container support in the support position; and a means for aligning a case facing edge on each container slide with an edge of the case disposed, in a tilted position, adjacent the case facing edge.

Embodiment F

A method comprises loading a packing station with a single column of containers from a container conveyor; sensing when a single column of containers is in the packing station; placing a plurality of cases in an inclined case loading position at the packing station, beneath and beside the single column of containers; sensing when the plurality of cases are in the inclined case loading position, dropping the containers when the sensing the single column of containers and the plurality of cases; guiding each container along an inclined chute from its first position in the packing station to its second position in a case; and assisting a movement of a fully packed case into an upright case discharged position. Two or more steps of method may be performed in parallel.

Embodiment G

A method comprises loading a packing station with a case load of containers from a container conveyor; sensing when the case load of containers is in the packing station; placing a plurality of cases in an inclined case loading position at the packing station, beneath and beside the case load of containers; sensing when the plurality of cases are in the inclined case loading position, dropping the case load of containers when sensing the case load of containers and sensing the plurality of cases; aligning a case facing portion of an inclined chute with an edge of an inclined case; and guiding each container along the inclined chute from its first position in the packing station to its second position in the case. Two or more steps of method may be performed in parallel.

Embodiment H

A case loader comprises a frame; a container station configured to receive containers therewithin; a container release; a container guide under the container station, the container guide being sized and shaped to gravity load containers, received within the container station and released with the container release, into a case though an open end thereof, the case being positioned at an incline relative to a case discharge position with the open end facing the container guide; and a case assist device.

Embodiment J

A case loader comprises a frame; a container station configured to receive containers therewithin; a container release; two chutes disposed, adjacent to each other, along a case movement direction, under the container station, each chute from two chutes comprises two side walls and a bottom wall, the bottom wall comprising a container facing edge and a case facing edge, each chute from the two chutes being sized and shaped to gravity load containers, received within the container station and released with the container release, into a case though an open end thereof, the case being positioned at an incline relative to a case discharge position with the open end facing a respective container chute.

Embodiment I

A container guide for a case loader comprises two chutes disposed, adjacent to each other, along a case movement direction, under a container station, each chute from two chutes comprises two side walls and a bottom wall, the bottom wall comprising a container facing edge and a case facing edge, each chute from the two chutes being sized and shaped to gravity load containers, received within the container station and released with a container release, into a case though an open end thereof, the case being positioned at an incline relative to a case discharge position with the open end facing a respective container chute.

A feature of this embodiment is that one chute from two chutes comprises and adjustable bottom wall.

A feature of this embodiment is that one chute from two chutes comprises and adjustable side wall.

A feature of this embodiment is that the container guide further comprises a device to align a case facing edge with an edge of the case.

A feature of this embodiment is that the container guide further comprises a device to vary an effective width of a chute at a case facing edge with.

A feature of this embodiment is that inner side walls of the two chutes may be designed to cross each other.

A feature of this embodiment is that at least one chute from the two chutes is designed with an adjustable side wall.

A feature of this embodiment is that a side wall of one chute crosses over a side wall of another chute.

Embodiment K

A case assist for a case loader comprises an arm with a flange at one end; a pivotal connection between another end of the arm and a support; and an actuator in a pivotal connection with each of the support and the arm.

Embodiment L

A case loader comprises a mounting component, an arm with a proximal end attached to the mounting component, the arm extending from the mounting component, a clevis pivotally attached to a distal end of the arm to pivot in a horizontal plane during operation of the device, and a bifurcated member pivotally attached to the clevis to pivot in a vertical plane during the operation of the case loader. This case loader may further comprise a latch. The latch may comprise a threaded member at a free end of each leg and a bar pivotally attached to one leg and releasably attached to another leg. The latch may comprise an external thread on a free end of each leg and a bar pivotally attached to one leg and releasably attached to another leg. The latch may comprise a threaded bore in a free end of each leg and a bar pivotally attached, with a first fastener, to one leg and releasably attached, with a second aperture, to another leg. The bar selectively connects the free ends of the first and second legs.

Embodiment M

A case loader comprises a mounting member, an arm with a proximal end attached to the mounting member, the arm extending from the mounting member, a clevis pivotally attached to a distal end of the arm to pivot in a horizontal plane during operation of the device, and a bifurcated member pivotally attached to the clevis to pivot in a vertical plane during the operation of the case loader. This case loader may also comprise an optional lock. The lock may comprise a threaded member at a free end of each leg. and a bar pivotally attached to one leg and releasably attached to another leg. The lock may comprise an external thread on a free end of each leg and a bar pivotally attached to one leg and releasably attached to another leg. The lock may comprise a threaded bore in a free end of each leg, and a bar pivotally attached, with a first fastener, to one leg and releasably attached, with a second aperture, to another leg, where the bar selectively connects the free ends of the first and second legs.

The chosen embodiments of the subject matter have been described and illustrated, to plan and/or cross section illustrations that are schematic illustrations of idealized embodiments, for practical purposes so as to enable any person skilled in the art to which it pertains to make and use the same. As such, variations from the shapes of the illustrations as a result, for example, of manufacturing techniques and/or tolerances, are to be expected. It is therefore intended that all matters in the foregoing description and shown in the accompanying drawings be interpreted as illustrative and not in a limiting sense. For example, a region illustrated or described as flat may, typically, have rough and/or nonlinear features. Moreover, sharp angles that are illustrated may be rounded and rounded angles may be sharp. Thus, the regions illustrated in the figures are schematic in nature and their shapes are not intended to illustrate the precise shape of a region and are not intended to limit the scope of the present claims. It will be understood that variations, modifications, equivalents and substitutions for components of the specifically described embodiments may be made by those skilled in the art without departing from the spirit and scope of the invention as set forth in the appended claims.

It should be appreciated that reference throughout this specification to "an embodiment" means that a particular feature, structure or characteristic described in connection with the embodiment is included in at least one embodiment of the disclosed subject matter. The particular features, structures or characteristics may be combined as suitable in one or more embodiments of the disclosed subject matter. Each embodiment may be employed alone or in any combination, and may include any one or more of the above features in any suitable combination.

Anywhere the term "comprising" is used, embodiments and components "consisting essentially of" and "consisting of" are expressly disclosed and described herein."

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

The Abstract is not intended to be limiting as to the scope of the claimed subject matter and is for the purpose of quickly determining the nature of the claimed subject matter.

What is claimed is:

1. A case loader, comprising:

a frame;

a container station configured to receive containers therewithin;

a container release;

two chutes disposed, adjacent to each other, along a case movement direction, under the container station, each chute from two chutes comprises two side walls and a bottom wall, the bottom wall being adjustable and being detached from the two side walls, the bottom wall comprising a container facing edge and a case facing edge, each chute from the two chutes being sized and shaped to gravity load containers, received within the container station and released with the container release, into a case though an open end thereof, the case being positioned at an incline relative to a case discharge position with the open end facing a respective chute;

wherein an angled side wall of one chute crosses over an angled side wall of another chute to accommodate a size expansion and a size contraction of a container during a sliding movement from the container station into the case.

2. The case loader of claim 1, further comprising a bracket disposed closer to the case facing edge of the bottom wall and below the bottom wall than to the container facing edge of the bottom wall and an actuator attached to the bracket, the actuator designed to adjustably move the case facing edge in a vertical direction.

3. The case loader of claim 1, wherein at least one chute from the two chutes is designed with an adjustable side wall.

4. The case loader of claim 1, further comprising an arm attached to the frame and a device with a first portion adjustably mounted on the arm and a second portion designed to contact one side wall near a case facing edge thereof, the first portion is adjustably moveable to move the one side wall.

5. The case loader of claim 1, further comprising a device with a first component mounted on the frame, a second component comprising one end connected to a bracket being disposed closer to the case facing edge of the bottom wall than to the container facing edge of the bottom wall, and a threaded connection between the first component and the second component, the second component designed to move the case facing edge of the bottom wall between the two side walls.

6. A case loader, comprising:

a frame;

a container station configured to receive containers therewithin;

a container release;

a chute adjacent the container station, the chute at least including two side walls disposed at a distance from each other across a width of the chute and a bottom wall, the bottom wall being detached from the two side walls;

an arm attached to the frame; and a device with a first portion adjustably mounted on the arm and a second portion designed to contact one side wall near a case facing edge thereof, the first portion being adjustably moveable to move a case facing edge of the one side wall to increase or decrease a width of the chute.

7. The case loader of claim 6, further comprising a powered case assist device.

8. The case loader of claim 7, wherein the powered case assist device comprises:

an actuator configured to generate a pivoting movement; and an arm connected to the actuator for the pivoting movement, the arm being shaped and sized to contact an edge of a case being positioned further from the frame and being aligned with a case discharge direction, the arm pulling the case, being fully loaded with containers, into a case discharge position due to the pivoting movement generated by the actuator.

9. The case loader of claim 7, wherein the powered case assist device comprises:

an actuator configured to generate a pivoting movement;

a support connectable to the frame and to the actuator, the support extending outwardly from the frame in a direction of a case when support connected to the frame; and an arm connected to the support for the pivoting movement, the arm shaped and sized to contact a side edge of an adjacent case to the case being fully loaded so as to move the adjacent case a distance away from the case being fully loaded.

10. The case loader of claim 7, wherein the powered case assist device comprises:

a support connectable to the frame, the support extending outwardly from the frame in a direction of a case when support connected to the frame;

an actuator mounted on a support, the actuator configured to generate a pivoting movement; and an arm connected to the actuator for the pivoting movement, the arm shaped and sized to contact a side edge of an adjacent case to the case being fully loaded so as to move the adjacent case a distance away from the case being fully loaded.

11. The case loader of claim 7, wherein the powered case assist device comprises:

an actuator configured to generate a rotational movement; and a roller connected to the actuator for the rotational movement, the roller positionable in a friction contact with a side surface of a case during operation of the case loader, the roller operable to maintain friction contact during the rotational movement;

the friction contact assisting the rotational movement of a fully loaded case into a case discharge position during a rotation of the roller.

12. The case loader of claim 7, wherein the powered case assist device comprises:

an actuator configured to generate a linear movement; and a stop connected to the actuator, the stop having a sloped surface;

the powered case assist device being positioned so that the sloped surface contacts an edge of an adjacent case to a case being loaded so as to move the adjacent case a distance away from the case being loaded.

13. The case loader of claim 7, wherein the powered case assist device comprises:

an actuator configured to generate a linear movement in a vertical direction; and a stop connected to the actuator;

the powered case assist device being positioned so that the stop contacts a surface of an adjacent case to a case being loaded so as to move the adjacent case a distance away from the case being loaded.

14. The case loader of claim 7, wherein the powered case assist device comprises:

an arm with a flange at one end of the arm;

a first pivot connection between an opposite end of the arm and the frame;

an actuator;

a second pivot connection between the actuator and the arm; and a third pivot connection between the actuator and the frame;

the actuator operable to pivot the arm between a case engaging position where the flange contacts an edge of a case and prevents tilting of the case and a case release position where the flange is disposed at a distance from the edge of the case and allows tilting of the case.

15. The case loader of claim 6, further comprises a component positioned above the chute and extending in a direction of the bottom wall, the component having one edge attached to the frame and having another edge positioned above the case facing edge.

16. A case loader, comprising:

a frame;

a container station configured to receive containers therewithin;

a container release;

a chute adjacent the container station, the chute at least including two side walls disposed at a distance from each across a width of the chute and a bottom wall, the bottom wall being detached from the two side walls;

a device with a first component mounted on the frame, a second component comprising one end connected to a bracket being disposed closer to a case facing edge of the bottom wall than to a container facing edge of the bottom wall, and a threaded connection between the first component and the second component, the second component designed to move the case facing edge of the bottom wall between the two side walls.

17. A case loader, comprising:

a frame;

a container station configured to receive containers therewithin;

a container release;

a container guide under the container station, the container guide at least including three sides disposed at a distance from each other and in a series with each other along a case movement direction and two slide components, each slide component being detached from respective side walls, the container guide being sized and shaped to gravity load containers, received within the container station and released with the container release, into a case though an open end thereof, the case being positioned at an incline relative to a case discharge position with the open end facing the container guide; and a powered case assist device.

18. The case loader of claim 17, wherein the container station comprises an adjustable container support.

19. The case loader of claim 17, wherein the container release comprises:

a case sensor;

a container sensor; and a latch assembly between the case sensor and the container sensor.

* * * * *